US009079415B2

(12) United States Patent
Tsukida et al.

(10) Patent No.: US 9,079,415 B2
(45) Date of Patent: Jul. 14, 2015

(54) LIQUID CONSUMING APPARATUS

(71) Applicant: Seiko Epson Corporation, Tokyo (JP)

(72) Inventors: Masaki Tsukida, Matsumoto (JP); Hidetoshi Yokoyama, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/549,716

(22) Filed: Nov. 21, 2014

(65) Prior Publication Data

US 2015/0151547 A1 Jun. 4, 2015

(30) Foreign Application Priority Data

Nov. 29, 2013 (JP) ..... 2013-247393

(51) Int. Cl.
*B41J 2/195* (2006.01)
*B41J 2/175* (2006.01)

(52) U.S. Cl.
CPC .... *B41J 2/17566* (2013.01); *B41J 2002/17573* (2013.01)

(58) Field of Classification Search
CPC ..... B41J 2/17566; B41J 2/17503; B41J 2/17506; B41J 2002/17573
See application file for complete search history.

(56) References Cited

U.S. PATENT DOCUMENTS 6,767,075 B1 * 7/2004 Takada et al. ..... 347/19
8,662,648 B2 3/2014 Kamiyanagi et al.

FOREIGN PATENT DOCUMENTS

JP 2013-099890 5/2013

* cited by examiner

*Primary Examiner* — Juanita D Jackson

(57) ABSTRACT

A printer includes a detection portion in which a light-emitting portion 92 and a light-receiving portion 94 are arranged in a main scanning direction, an ink cartridge in which a prism 170 is arranged, the prism having an edge line aligned with a sub-scanning direction and a bottom face 170*c* facing the detection portion, a holder 20 in which the ink cartridge is attachably and detachably installed and that has an opening portion 22 at a position in a bottom portion 21 arranged so as to face the detection portion, the position facing a bottom face 170*c* of the prism, and a carriage motor 33 that relatively moves the holder 20 with respect to the detection portion in the main scanning direction. The bottom portion 21 of the holder 20 has, on the side facing the detection portion, an inclined face 21*a* inclining in a sub-scanning direction.

5 Claims, 20 Drawing Sheets

LIQUID CONSUMING APPARATUS

BACKGROUND

1. Technical Field

The present invention relates to a liquid consuming apparatus.

2. Related Art

In an inkjet printer serving as an exemplary liquid consuming apparatus, in general, an ink cartridge, which is a detachable liquid container, is installed. A printer is disclosed that includes an ink cartridge provided with a prism, a holder (carriage) in which the ink cartridge is installed and that is provided with an opening portion at a position corresponding to the prism, and a detection portion having a light-emitting portion and a light-receiving portion, in order to detect the amount of remaining ink in the ink cartridge (e.g., see JP-A-2013-99890).

When the light radiated by the light-emitting portion and entering from the opening portion of the holder is reflected at an inclined face of the prism, the state of reflection differs depending on whether or not the inclined face is in contact with the ink. Using this fact, the amount of remaining ink is detected based on the level of intensity or the like of the reflected light that enters the light-receiving portion. For this reason, for example, the reflected light that is reflected at the holder, a bottom face of the prism, or the like could be noise light and be a factor that hinders accurate detection of the amount of remaining ink in some cases.

In the printer described in JP-A-2013-99890, a light-blocking portion is provided in the opening portion of the holder. When the holder moves in a direction in which the light-emitting portion and the light-receiving portion are arranged, a part of the light radiated from the light-emitting portion is blocked by the light-blocking portion, thereby suppressing reflection at the bottom face of the prism. Furthermore, the light entering the light-blocking portion is caused to be reflected in a direction other than the direction toward the light-receiving portion by forming the bottom face (a face facing the detection portion) of the light-blocking portion into an inclined face aligned with the direction in which the light-emitting portion and the light-receiving portion are arranged. Thus, reduction of the noise light is achieved.

The amount of remaining ink is detected when relative positions of the prism and the detection portion reach a predetermined position. Meanwhile, a detection position that is set as the predetermined position is shifted from an originally-assumed detection position in some cases. For this reason, for example, before the amount of remaining ink is detected, the holder is relatively moved with respect to the detection portion, and the detection position is corrected based on the intensity level or the like of the reflected light received by the light-receiving portion. However, if the holder is relatively moved with respect to the detection portion in order to correct the detection position in the printer described in JP-A-2013-99890, there is a possibility that the light radiated by the light-emitting portion is reflected at the bottom portion (a face facing the detection portion) of the holder and enters the light-receiving portion. Furthermore, the bottom face (a face facing the detection portion) of the light-blocking portion is an inclined face aligned with the direction in which the light-emitting portion and the light-receiving portion are arranged. Accordingly, there is a possibility that light radiated from the light-emitting portion and proceeds obliquely with respect to the normal direction of the bottom face of the prism is reflected at the inclined face of the light-blocking portion and enters the light-receiving portion. Such reflected light that is reflected at the bottom portion of the holder or the light-blocking portion is noise light and is a factor that decreases accuracy of correction of the detection position and the accuracy of detection of the amount of remaining ink.

SUMMARY

The invention can be realized in the following modes or application examples.

APPLICATION EXAMPLE 1

A liquid consuming apparatus according to this application example includes: a detection portion in which a light-emitting portion and a light-receiving portion are arranged in a first direction; a liquid containing portion in which a prism is arranged, the prism having an edge line aligned with a direction intersecting the first direction, and a face facing the detection portion; a holder in which the liquid containing portion is attachably and detachably installed, the holder having, in a portion thereof facing the detection portion, an opening portion at a position facing the face of the prism; and a moving portion that relatively moves the holder with respect to the detection portion in the first direction. The portion of the holder has, on a side facing the detection portion, a first inclined face inclining in a second direction that is other than the first direction.

With the configuration of this application example, the holder that holds the liquid containing portion in the liquid consuming apparatus has the first inclined face inclining in the second direction, which is other than the first direction, in the portion (hereinafter referred to as a bottom portion) facing the detection portion. For this reason, the reflected light that is radiated from the light-emitting portion and is reflected at the first inclined face of the bottom portion travels in a direction other than the direction in which the light-emitting portion and the light-receiving portion are arranged. With this configuration, incidence of reflected light (noise light) that is reflected at the bottom portion of the holder into the light-receiving portion is suppressed. Accordingly, correction accuracy at the time of correcting the detection position can be improved, based on the intensity level or the like of the reflected light received by the light-receiving portion with respect to a change of the relative positions of the holder and the detection portion when the holder is relatively moved with respect to the detection portion. Furthermore, when the amount of remaining ink is detected, even if the light radiated from the light-emitting portion and travelling obliquely with respect to the normal direction of the face (hereinafter referred to as a bottom face) of the prism that faces the detection portion is reflected at the bottom portion of the holder, incidence of reflected light (noise light) into the light-receiving portion due to the reflected light travelling in a direction other than the direction in which the light-emitting portion and the light-receiving portion are arranged is suppressed. Accordingly, the accuracy of detection of the amount of remaining ink can be improved.

APPLICATION EXAMPLE 2

In the liquid consuming apparatus according to the above application example, it is preferable that the holder holds a plurality of the liquid containing portions in an attachable and detachable manner, the opening portion is provided so as to correspond to the prism in each of the liquid containing portions, and the first inclined face is arranged between the opening portions that are adjacent to each other.

With the configuration of this application example, the opening portion is provided so as to correspond to the prism in each of the liquid containing portions held by the holder, and the first inclined face is arranged between the opening portions adjacent to each other. For this reason, when the detection position is corrected or when the amount of remaining ink is detected, even if the holder is relatively moved with respect to the detection portion such that the prism in each of the liquid containing portions faces the detection portion, incidence of reflected light (noise light) that is reflected at the bottom portion of the holder into the light-receiving portion is suppressed. Thus, the accuracy of correction of the detection position and the accuracy of detection of the amount of remaining ink can be improved.

APPLICATION EXAMPLE 3

In the liquid consuming apparatus according to the above application example, it is preferable that the portion has a saw blade-like cross-sectional shape in which a plurality of the first inclined faces are arranged so as to be aligned with the second direction.

With the configuration of this application example, the bottom portion of the holder is provided with the first inclined faces so as to be arranged in the second direction, and has a saw blade-like cross-sectional shape. If the relative positions of the detection portion with respect to the holder are shifted in the second direction, a difference occurs in the distance between the bottom portion and the detection portion depending on the shifted position, since the bottom portion facing the detection portion has the first inclined faces. If the light radiated from the light-emitting portion has a relatively wide directional angle, the amount of the radiated light and the reflected light (light reflected at the bottom face of the prism) that pass through the opening portion increases as the distance between the bottom portion and the detection portion is larger. Accordingly, if the relative position of the detection portion with respect to the holder is shifted in the second direction, the intensity level of the reflected light varies, and the accuracy of correction of the detection position and the accuracy of detection of the amount of remaining ink will decrease. Here, since the bottom portion of the holder is provided with the first inclined faces so as to be arranged in the second direction, the difference in the distance between the bottom portion and the detection portion when the relative position of the detection portion with respect to the holder is shifted is smaller, as compared with a case where a single inclined face is provided at the same inclination angle as that of the first inclined faces, in a range where the plurality of first inclined faces are provided in the second direction. Thus, variation of the amount of the radiated light and the reflected light that pass through the opening portion is reduced, and it is accordingly possible to suppress a decrease in the accuracy of correction of the detection position and the accuracy of detection of the amount of remaining ink due to variation of the intensity level of the reflected light.

APPLICATION EXAMPLE 4

In the liquid consuming apparatus according to the above application example, it is preferable that the holder has a light-blocking portion provided so as to cover a part of the opening portion, and the light-blocking portion has, on a side facing the detection portion, a second inclined face inclining in a third direction that is other than the first direction.

With the configuration of this application example, since the light-blocking portion is provided so as to cover a part of the opening portion, a part of the light entering the bottom face of the prism is blocked, and the reflection light at the bottom face of the prism is suppressed. Furthermore, since the light-blocking portion has, on the side facing the detection portion, the second inclined face inclining in the third direction, which is other than the first direction, incidence of reflected light (noise light) into the light-receiving portion can be suppressed even if the radiated light from the light-emitting portion is reflected at the second inclined face.

APPLICATION EXAMPLE 5

In the liquid consuming apparatus according to the above application example, it is preferable that the second direction and the third direction are perpendicular to the first direction, and the first inclined face and the second inclined face incline in orientations opposite to each other.

With the configuration of this application example, the first inclined face of the bottom portion and the second inclined face of the light-blocking portion incline in orientations opposite to each other, in a direction perpendicular to the direction in which the light-emitting portion and the light-receiving portion are arranged. For this reason, in a range where the relative position of the detection portion with respect to the holder is shifted in the direction in which the light-emitting portion and the light-receiving portion are arranged, the distance between the light-blocking portion and the detection portion is smaller at a position where the distance between the bottom portion and the detection portion is larger, and the distance between the light-blocking portion and the detection portion is larger at a position where the distance between the bottom portion and the detection portion is smaller. Thus, variation of the amount of the radiated light and the reflected light that pass through the opening portion is reduced, and accordingly, it is possible to suppress a decrease in the accuracy of correction of the detection position and the accuracy of detection of the amount of remaining ink due to variation of the intensity level of the reflected light.

BRIEF DESCRIPTION OF THE DRAWINGS

The invention will be described with reference to the accompanying drawings, wherein like numbers reference like elements.

DESCRIPTION OF EXEMPLARY EMBODIMENTS

The following describes embodiments of the invention with reference to the drawings. The used drawings are enlarged, shrunk, or exaggerated as appropriate such that described parts can be recognized. Parts other than constituent components necessary for description are omitted in some cases.

First Embodiment

Basic Configuration of Printer

Figure 1:
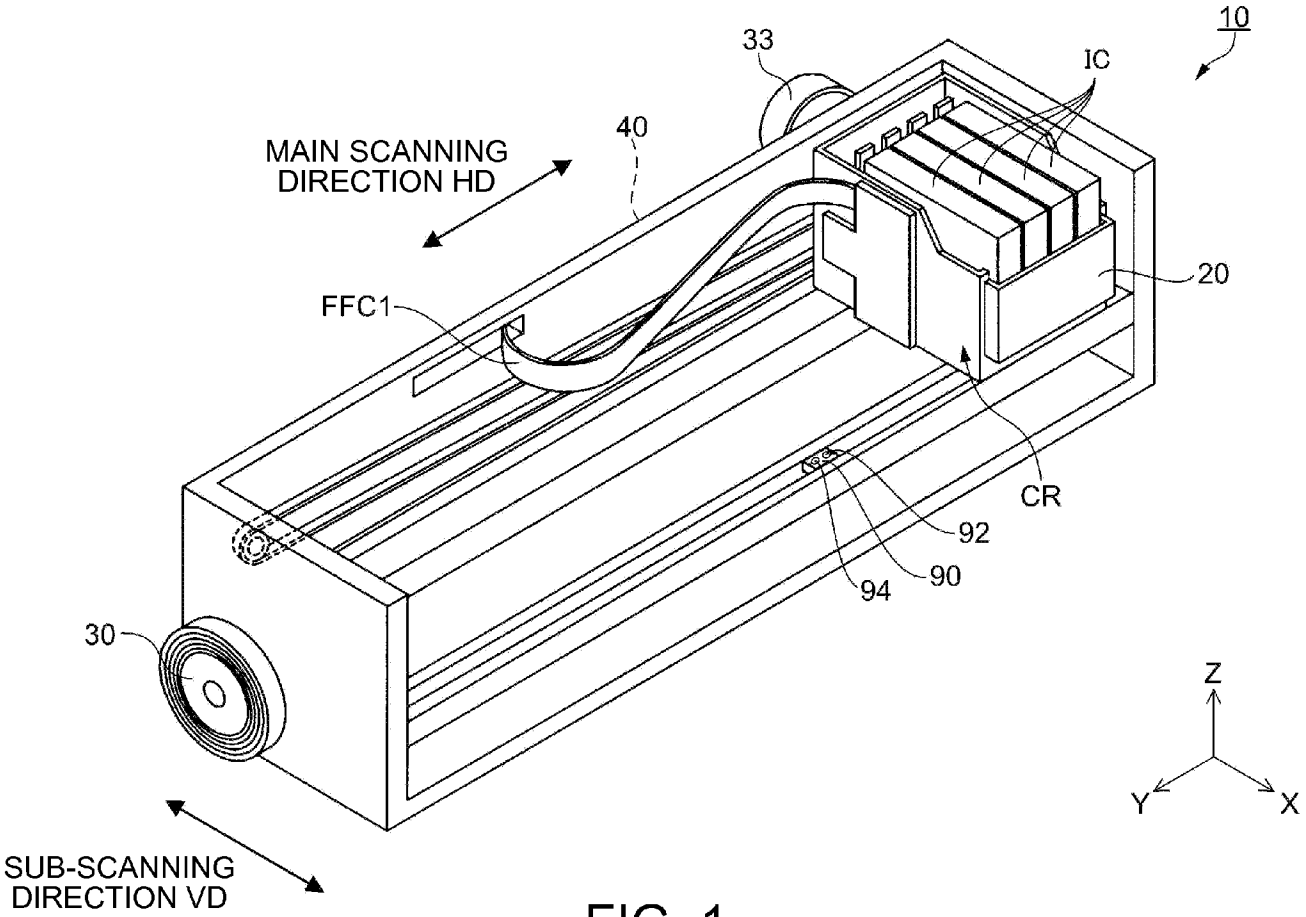
FIG. 1 is a perspective view showing a main part of a printer according to a first embodiment.
Figure 2:
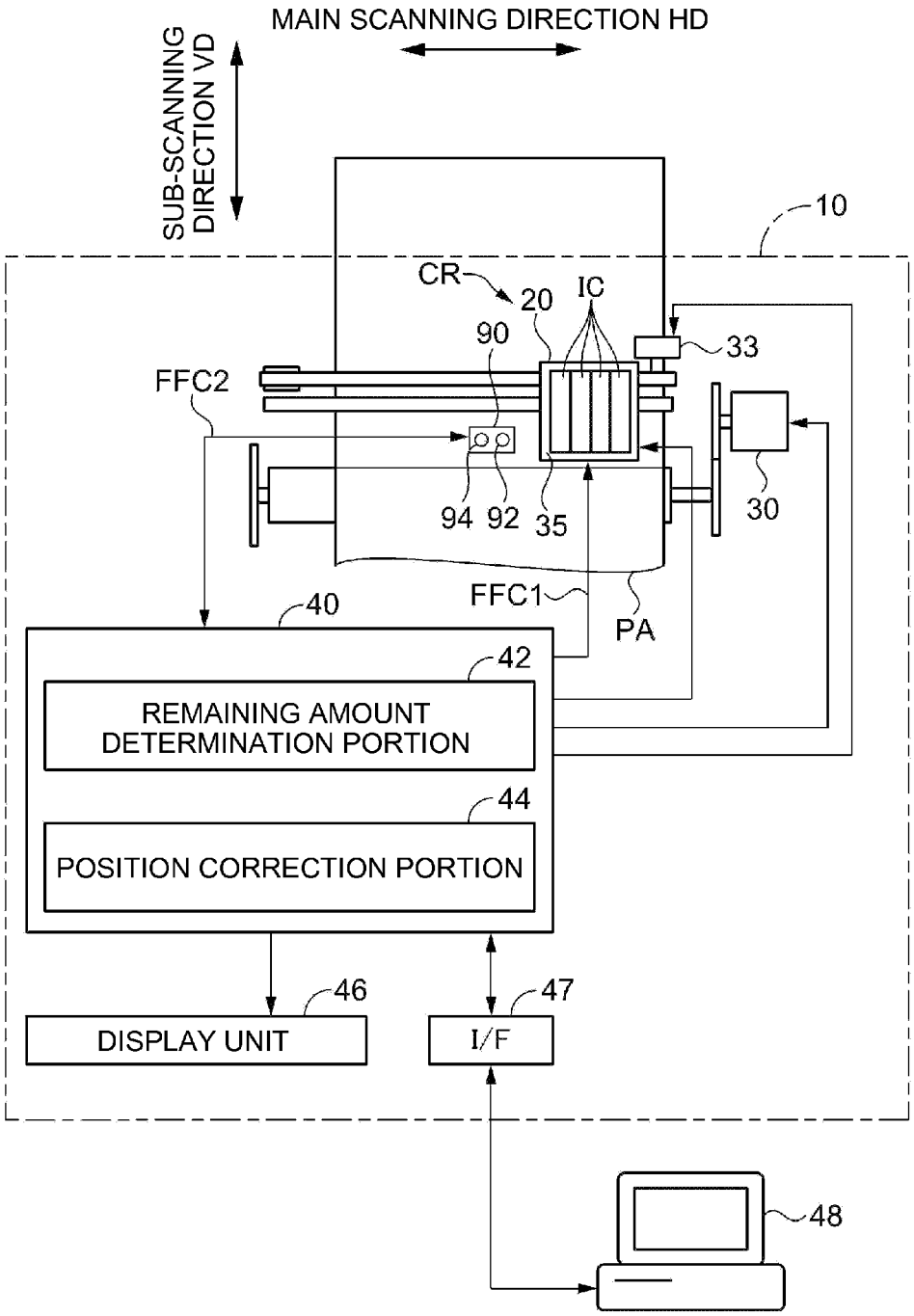
FIG. 2 is a schematic block diagram of the printer according to the first embodiment.

A basic configuration of a printer serving as a liquid consuming apparatus according to a first embodiment will be described with reference to FIGS. 1 and 2. FIG. 1 is a perspective view showing a main part of the printer according to the first embodiment. FIG. 2 is a schematic block diagram of the printer according to the first embodiment.

FIG. 1 shows a Y-axis direction serving as a first direction, an X-axis direction that is perpendicular to the Y-axis direction and serves as a second direction and a third direction, and a Z-axis direction perpendicular to the X-axis direction and the Y-axis direction. In the present embodiment, in the posture of a printer 10 when in use, the Z-axis direction (+Z direction and −Z direction) is the vertical direction, and a +X direction is the direction toward the front of the printer 10. The Y-axis direction (+Y direction and −Y direction) is a main scanning direction HD of the printer 10, and the X-axis direction (+X direction and −X direction) is a sub-scanning direction VD of the printer 10.

As shown in FIG. 1, the printer 10 includes a plurality of ink cartridges IC each serving as a liquid containing portion, a carriage CR including a holder 20, a paper feed motor 30, a carriage motor 33 serving as a moving portion, a cable FFC1, a detection portion 90, and a control unit 40. For example, cyan ink, magenta ink, yellow ink, and black ink are contained in the respective ink cartridges IC. The ink cartridges IC are installed in the holder 20. Note that the holder 20 may be formed as a member integrated with the carriage CR, or may be formed as a separate member and incorporated in the carriage CR.

As shown in FIG. 2, the carriage CR includes the holder 20 and a print head 35. The carriage CR moves back and forth above a print medium PA in the main scanning direction HD, by being driven by the carriage motor 33. The paper feed motor 30 conveys the print medium PA in the sub-scanning direction VD. The print head 35 is carried in the carriage CR, and discharges ink supplied from the ink cartridges IC. Note that, in FIGS. 1 and 2, the carriage CR is located at its home position.

The detection portion 90 outputs a signal for detecting the amount of remaining ink in the ink cartridges IC to the control unit 40. The detection portion 90 includes a light-emitting portion 92 (light-emitting device) that radiates light toward a prism 170 (see FIG. 4) in each ink cartridge IC, and a light-receiving portion 94 (light-receiving device) that receives reflected light from the prism 170 and converts it into an electric signal.

Figure 3:
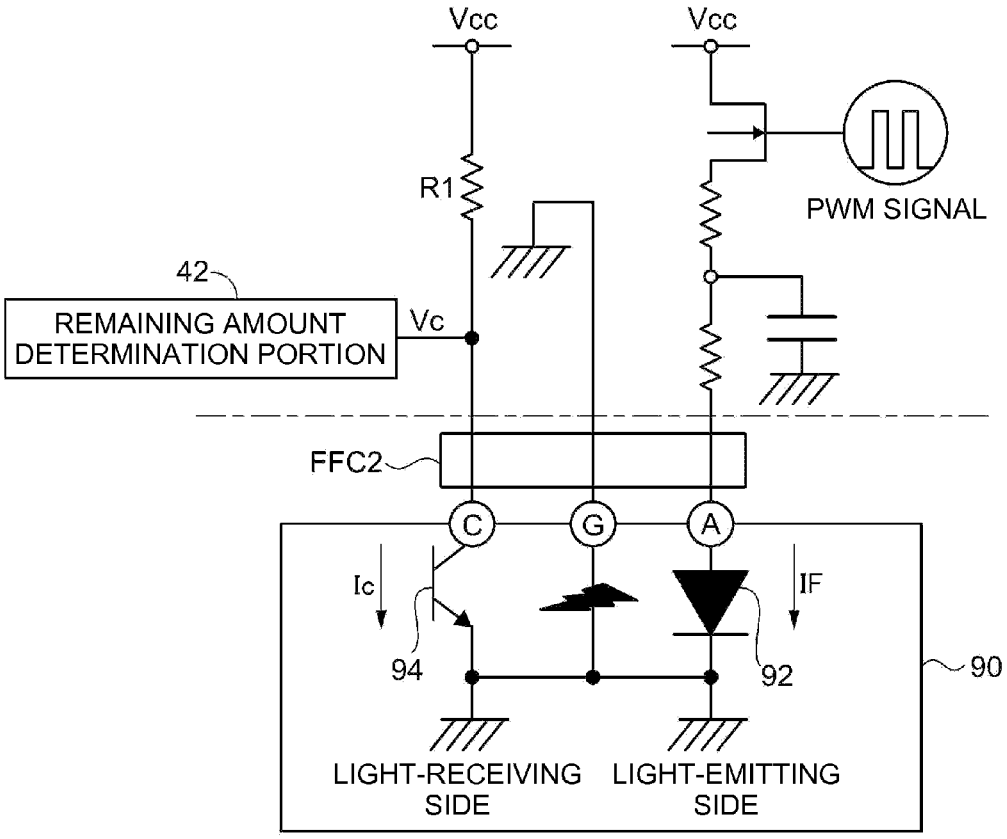
FIG. 3 is an illustrative diagram showing an electric configuration of a detection portion.

FIG. 3 is an illustrative diagram showing an electric configuration of the detection portion. For example, the detection portion 90 includes an LED (Light Emitting Diode) as the light-emitting portion 92 (light-emitting device), and includes a phototransistor as the light-receiving portion 94 (light-receiving device). An emitter terminal of the light-receiving portion 94 is grounded, and a collector terminal thereof is connected to power supply potential Vcc via a resistor R1. Electric potential between the resistor R1 and the collector terminal is input, as output voltage Vc (detection voltage) of the detection portion 90, to a remaining amount determination portion 42, details of which will be described later.

The amount of the light radiated by the light-emitting portion 92 is set by a duty ratio (ratio between on-time and off-time) of a PWM (Pulse Width Modulation) signal applied to the light-emitting portion 92 being adjusted by the control unit 40. When the radiated light that is radiated from the light-emitting portion 92 is reflected at the prism 170 in each ink cartridge IC and the reflected light is received by the light-receiving portion 94, the output voltage Vc corresponding to the amount of the received light is input as an output signal to the remaining amount determination portion 42. In the present embodiment, as the amount of the light to be received by the light-receiving portion 94 is larger, the output voltage Vc to be output from the detection portion 90 is smaller.

As shown in FIGS. 1 and 2, the light-emitting portion 92 and the light-receiving portion 94 provided in the detection portion 90 are arranged so as to be aligned with the main scanning direction HD (Y-axis direction) in which the holder 20 moves. The holder 20 is relatively moved with respect to the detection portion 90 in the main scanning direction HD by the carriage motor 33. The light-emitting portion 92 and the light-receiving portion 94 are arranged so as to face the prism 170 in each ink cartridge IC via a corresponding opening portion 22 (see FIG. 5B) of the holder 20 when the holder 20 is moved by the carriage motor 33 and is located above the detection portion 90.

The control unit 40 has the remaining amount determination portion 42 and a position correction portion 44. A display unit 46 on which an operation state or the like of the printer 10 is displayed is connected to the control unit 40. A computer 48 is connected to the control unit 40 via an interface (I/F) 47. Furthermore, the carriage CR is connected to the control unit 40 via the cable FFC1, and the detection portion 90 is connected to the control unit 40 via a cable FFC2.

The control unit 40 includes a CPU, a ROM, a RAM, and the like (not shown). The CPU functions as the remaining amount determination portion 42 and the position correction portion 44 by deploying control programs stored in advance in the ROM onto the RAM and executing it. The control unit 40 also controls printing on the print medium PA by controlling the paper feed motor 30, the carriage motor 33, and the print head 35.

The remaining amount determination portion 42 determines, using the prism 170, the amount of remaining ink in each ink cartridge IC. The remaining amount determination portion 42 acquires the output voltage Vc (detection voltage) at the time when the prism 170 is located at a predetermined position (detection position) with respect to the detection portion 90, from the detection portion 90 via the cable FFC2. The remaining amount determination portion 42 then determines whether or not the amount of the ink in each ink cartridge IC has become smaller than or equal to a predetermined amount, based on the acquired output voltage Vc and a predetermined threshold value. The state where the amount of remaining ink has become smaller than or equal to the predetermined amount will be hereinafter referred to also as an "ink near-end" state.

Regarding the ink cartridge IC that is in the ink near-end state according to the determination, the control unit 40 outputs an instruction to display an alarm for indicating ink replacement to the display unit 46 of the printer 10 and a display unit of the computer 48, and thus prompts a user to replace the ink cartridge IC. The control unit 40 determines that the ink cartridge IC is empty when a predetermined amount of the ink is consumed after it is determined that the ink cartridge IC is in the ink near-end state. The control unit 40 may determine that the ink cartridge IC is empty when determining that the ink cartridge IC is in the ink near-end state. If the control unit 40 determines that the ink cartridge IC is empty, the control unit 40 does not execute printing until the ink cartridge IC is replaced.

The position correction portion 44 corrects information of the position of each prism 170 with respect to the detection portion 90 in the main scanning direction HD, based on the detection voltage (output voltage Vc) from the detection portion 90. If the actual relative position of the prism 170 with respect to the detection portion 90 is shifted from the designed relative position thereof, the accuracy of the ink near-end determination for the ink cartridges IC decreases. For this reason, peak detection is performed on the detection voltage from the detection portion 90 for each ink cartridge IC, and the relative position of the holder 20 (prism 170) with respect to the detection portion 90 at the time when the ink near-end determination is performed is corrected based on a detected peak position. The details will be described later.

The position of the carriage CR (holder 20) is perceived based on the output of a rotary encoder carried in the carriage motor 33. That is to say, the rotary encoder outputs a count value corresponding to the amount of movement from the home position of the carriage CR, which is regarded as a reference position, for example. A predetermined count value of the rotary encoder corresponds to the center position of the prism 170 in each ink cartridge IC. Prior to the position correction, the count value corresponding to each position is mechanically set based on a design value, and is stored in an EEPROM (nonvolatile memory) in the control unit 40, for example. The position correction portion 44 corrects the count value corresponding to each position by performing position correction processing, and writes the corrected count value in the RAM.

Configuration of Ink Cartridge

Figure 4:
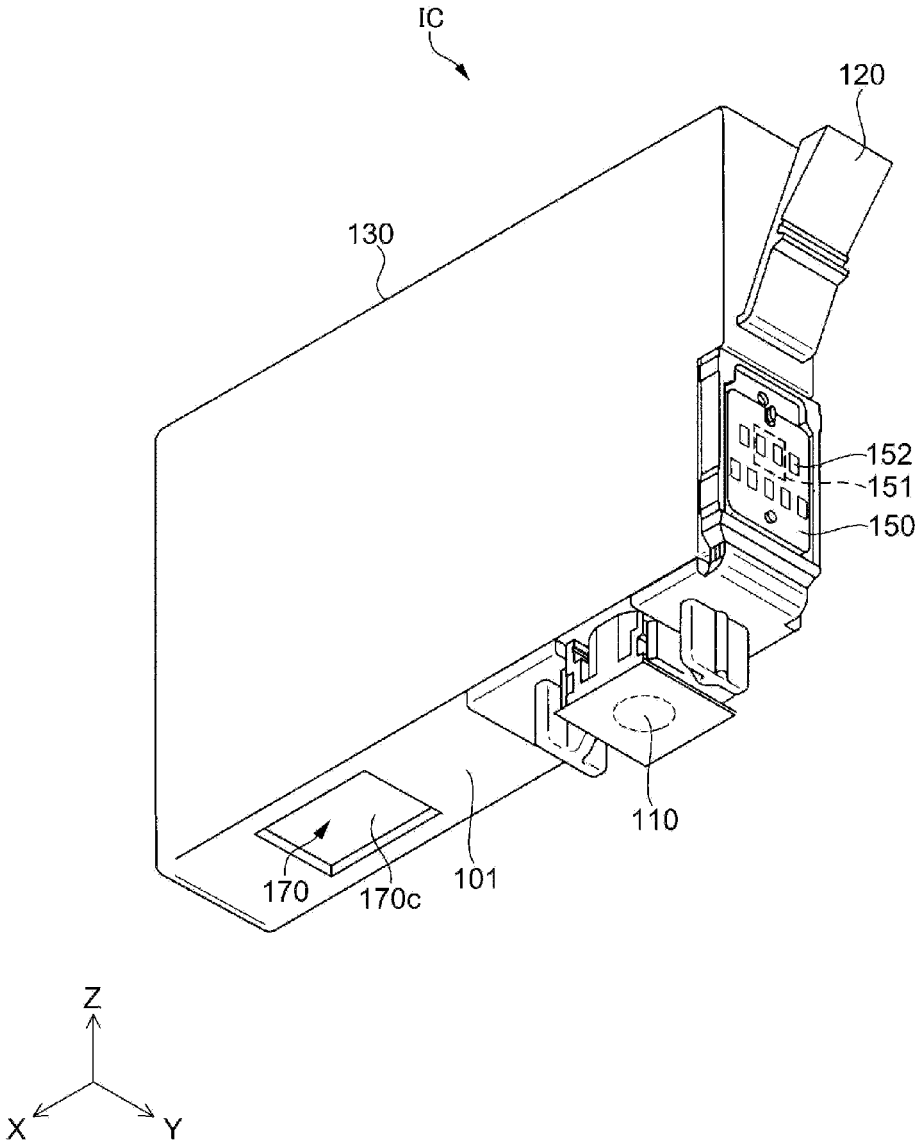
FIG. 4 is a perspective view of an ink cartridge.

FIG. 4 is a perspective view of an ink cartridge. Each ink cartridge IC includes a substantially rectangular-parallelepiped ink containing chamber 130 that contains ink, a circuit board 150, and a lever 120 for attaching and detaching the ink cartridge IC to/from the holder 20. The circuit board 150 is provided on the side in the −Z direction, in a face of the ink containing chamber 130 on the side in the −X direction. The lever 120 is provided on the side in the +Z direction, in the face of the ink containing chamber 130 on the side in the −X direction.

The prism 170, which has a rectangular equilateral triangle column shape, is arranged in a bottom portion of the ink containing chamber 130. A bottom face 170*c* of the prism 170 that is a face facing the detection portion 90 is an incident face that the radiated light from the light-emitting portion 92 (see FIG. 2) enters, and is exposed from a bottom face 101 of the ink cartridge IC that is a face on the side in the −Z direction.

An ink supply port 110, into which an ink receiving needle (not shown) provided in the holder 20 is inserted when the ink cartridge IC is installed in the holder 20, is formed in the bottom face 101 of the ink cartridge IC. In a state where the ink cartridge IC is unused, the ink supply port 110 is sealed by a film. Upon the ink cartridge IC being installed from above into the holder 20 (see FIG. 1), the film is torn by the ink receiving needle, and the ink is supplied from the ink containing chamber 130 to the print head 35 through the ink supply port 110.

A storage device 151 for recording information related to the ink cartridge IC is attached to a back face of the circuit board 150. A plurality of terminals 152 that are electrically connected to the storage device 151 are arranged in a front face of the circuit board 150. When the ink cartridge IC is installed in the holder 20, the terminals 152 come into electric contact with a plurality of body terminals (not shown) provided in the holder 20.

These body terminals are electrically connected to the control unit 40 via the cable FFC1. Thus, when the ink cartridge IC is installed in the holder 20, the control unit 40 is electrically connected to the storage device 151, and can read and write data from/to the storage device 151. As the storage device 151, for example, a nonvolatile memory such as an EEPROM can be used.

Configuration of Holder

Figure 5A:
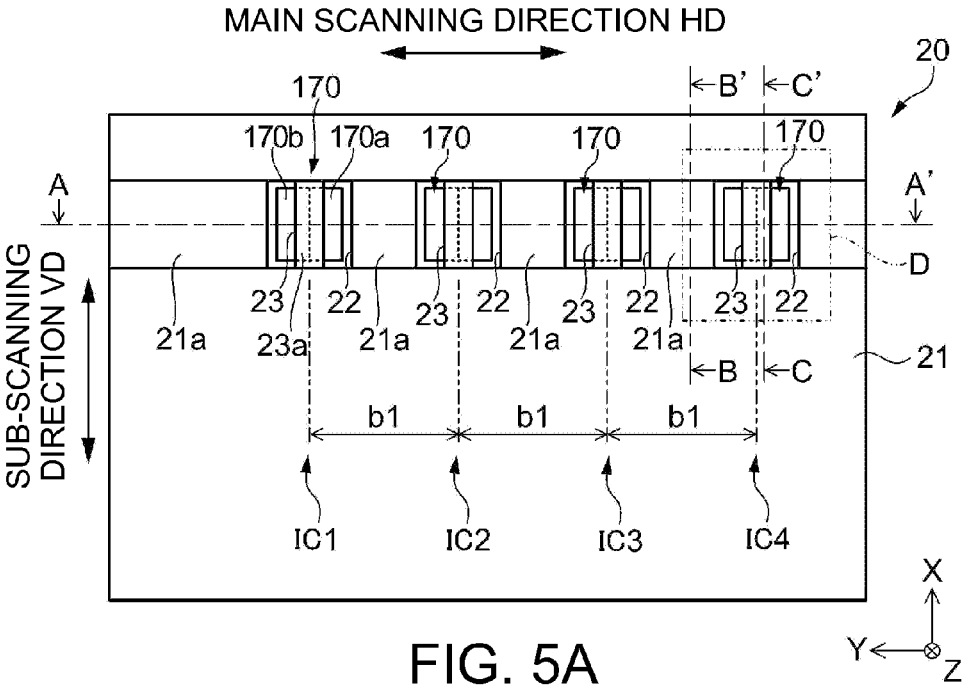
FIGS. 5A and 5B are diagrams illustrating a configuration of a holder according to the first embodiment.
Figure 5B:
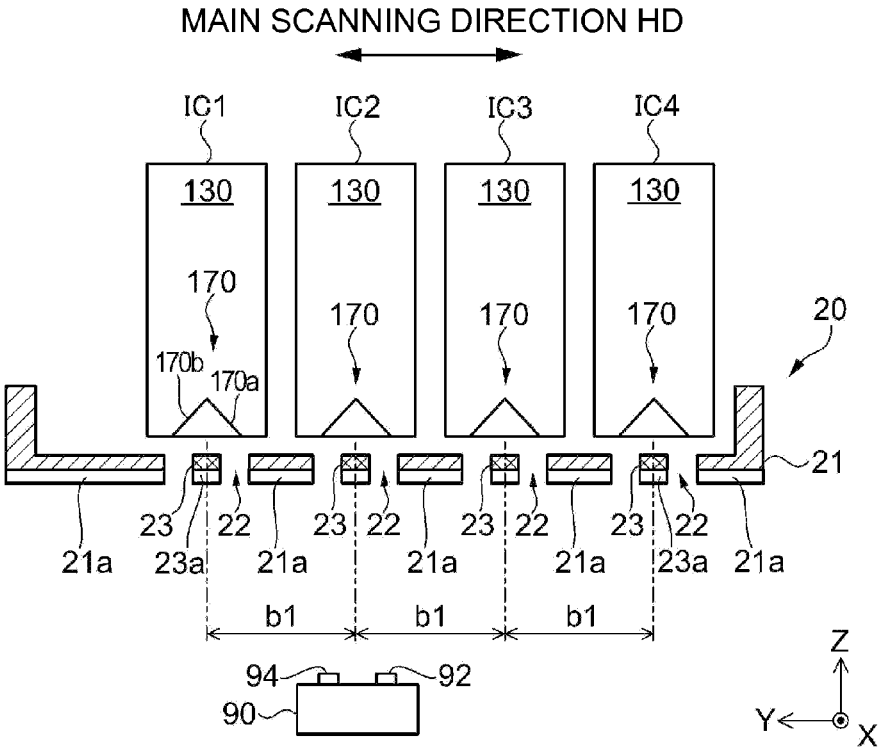

FIGS. 5A and 5B are diagrams illustrating a configuration of the holder according to the first embodiment. FIG. 5A is a schematic view of a bottom portion 21 of the holder 20 as seen from the side of the detection portion 90. FIG. 5B is a schematic view of a YZ cross-section of the holder 20 in which the ink cartridges IC are installed. FIG. 5B corresponds to a cross-sectional view taken along line A-A' in FIG. 5A. As shown in FIGS. 5A and 5B, the bottom portion 21, which is a portion of the holder 20 that faces the detection portion 90, has an inclined face 21*a* that inclines in a direction other than the main scanning direction HD (Y-axis direction). In the present embodiment, the inclined face 21*a* inclines in the sub-scanning direction VD (X-axis direction).

The bottom portion 21 of the holder 20 also has, for example, four opening portions 22 that are provided so as to be aligned with the main scanning direction HD. Each opening portion 22 is arranged so as to be sandwiched between portions of the inclined face 21*a* in the main scanning direction HD. In other words, the inclined face 21*a* is arranged between the opening portions 22 that are adjacent to each other in the main scanning direction HD, and on both outer sides of the four opening portions 22 in the main scanning direction HD. Four ink cartridges IC1 to IC4 are installed in the holder 20 at positions corresponding to the respective opening portions 22.

The prisms 170 provided in the ink containing chambers 130 of the ink cartridges IC1 to IC4 each have an inclined face 170*a* and an inclined face 170*b*. The inclined face 170*a* and the inclined face 170*b* constitute an edge line of the prism 170 that is aligned with the sub-scanning direction VD (X-axis direction) intersecting the main scanning direction HD (Y-axis direction). The prism 170 has a rectangular equilateral triangle shape with a vertex angle formed by the inclined face 170*a* and the inclined face 170*b*, as seen from the X-axis direction.

The prism 170 is made of a member, such as polypropylene, that transmits the radiated light from the light-emitting portion 92. The state of reflection of the radiated light entering each prism 170 from the light-emitting portion 92 differs depending on the refractive index of a fluid (ink or air) that is in contact with the inclined faces 170*a* and 170*b*. The opening portions 22 are arranged at positions facing the light-emitting portion 92 and the light-receiving portion 94 provided in the detection portion 90 when the respective prisms 170 in the ink cartridges IC1 to IC4 are located immediately above the detection portion 90 as a result of the holder 20 moving back and forth.

Upon the carriage CR including the holder 20 moving in the main scanning direction HD (Y-axis direction), the ink cartridges IC1 to IC4 sequentially pass above the detection portion 90 (+Z direction). Then, the radiated light from the light-emitting portion 92 is reflected at the prism 170 in each ink cartridge IC through the corresponding opening portion 22, and the reflected light is received by the light-receiving portion 94. The detection portion 90 outputs a result of light reception by the light-receiving portion 94 as an output signal corresponding to the position of the carriage CR (prism 170). In the present embodiment, the ink near-end determination for each ink cartridge IC and correction of the detection position for performing the ink near-end determination are performed, based on this output signal of the detection portion 90 that corresponds to the position of the carriage CR.

A light-blocking portion 23 that blocks the radiated light from the light-emitting portion 92 is provided at the center of each opening portion 22 so as to cover a part of the opening portion 22. The center of each opening portion 22 is the position corresponding to the edge line (center) of the corresponding prism 170 when the ink cartridge IC is installed in the holder 20. The center positions of two adjacent opening portions 22 are separate from each other by the distance b1. Accordingly, the center positions of adjacent light-blocking portions 23 are separate from each other by the distance b1. This distance b1 is mechanically set based on a design value.

Figure 7A:
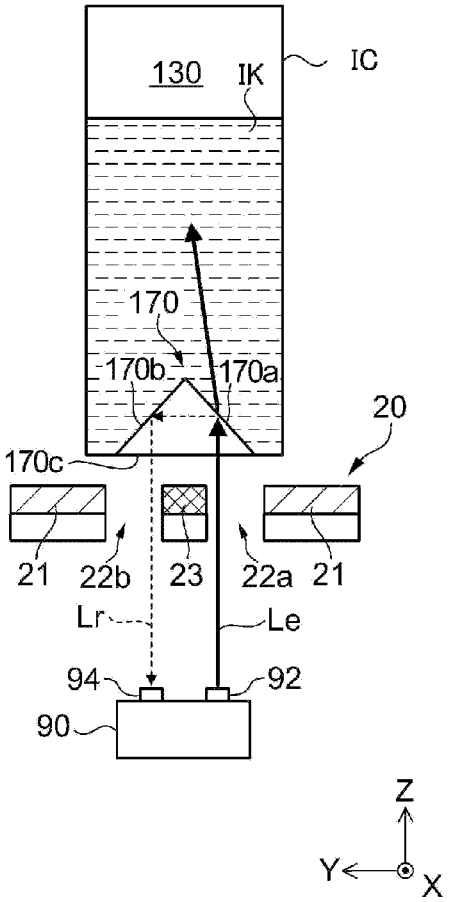
FIGS. 7A and 7B are diagrams illustrating an ink near-end determination method.
Figure 7B:
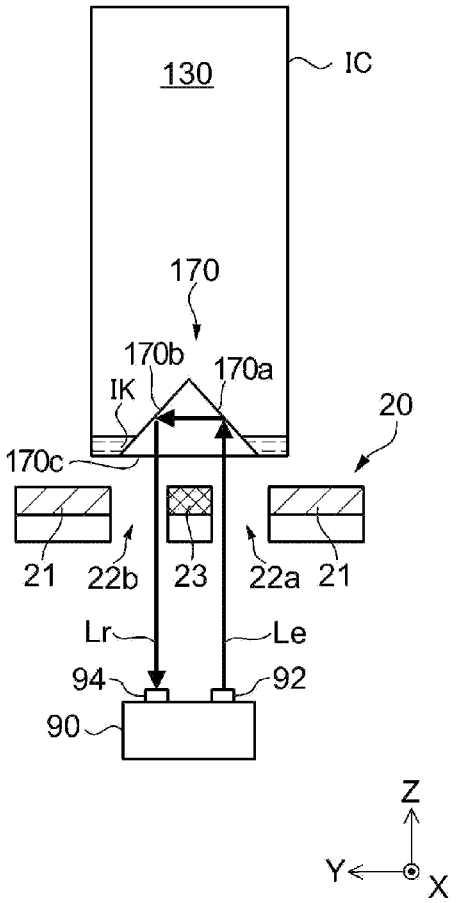

The light-blocking portions 23 are provided so as to be aligned with the sub-scanning direction VD (X-axis direction) intersecting the main scanning direction HD (Y-axis direction), and each light-blocking portion 23 divides the corresponding opening portion 22 of the holder 20 into two parts, namely an opening portion 22*a* and an opening portion 22*b* (see FIGS. 7A and 7B). Each light-blocking portion 23 is arranged at a position facing the edge line of the corresponding prism 170. At the detection position for performing the ink near-end determination, the opening portion 22*a*, which is a part of each opening portion 22 divided into two parts by the corresponding light-blocking portion 23, is located at a position at which the light-emitting portion 92 and the inclined face 170*a* face each other, and the opening portion 22*b*, which is the other part of the opening portion 22, is located at a position at which the light-receiving portion 94 and the inclined face 170*b* face each other.

Each light-blocking portion 23 has, on the side of the detection portion 90, an inclined face 23*a* that inclines in a direction other than the main scanning direction HD (Y-axis direction). In the present embodiment, the inclined face 23*a* inclines in the sub-scanning direction VD (X-axis direction). The light-blocking portions 23 are made of a light-absorbing material, such as black-colored polystyrene. In the present embodiment, the light-blocking portions 23 are made of the same material as that of the holder 20, and are formed integrally therewith. Note that the material of the light-blocking portions 23 is not limited to the above, and may be any material that can suppress the reflected light entering the light-receiving portion 94. Furthermore, a configuration may also be employed in which the light-blocking portions 23 are formed separately from the holder 20 and is attached to the holder 20.

Figure 6A:
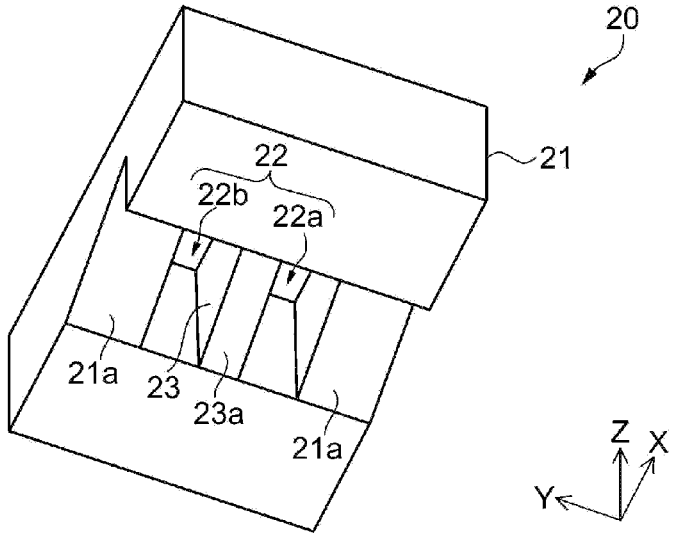
FIGS. 6A to 6C are diagrams illustrating inclined faces of the holder according to the first embodiment.
Figure 6B:
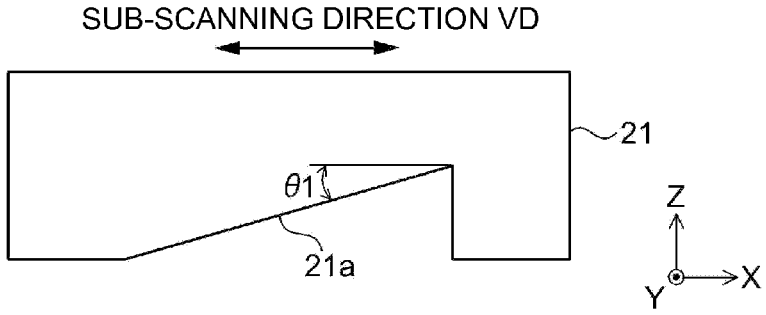
Figure 6C:
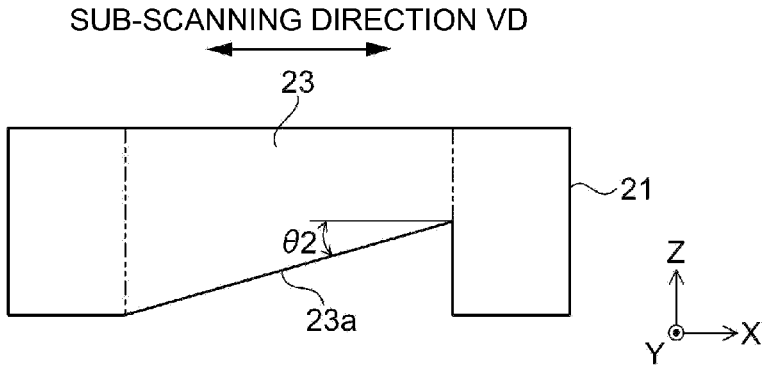

FIGS. 6A to 6C are diagrams illustrating the inclined faces of the holder according to the first embodiment. FIG. 6A is an enlarged perspective view of a part D in FIG. 5A. FIG. 6B is a schematic view of an XZ cross-section of the bottom portion 21, and corresponds to a cross-sectional view taken along line B-B' in FIG. 5A. FIG. 6C is a schematic view of an XZ cross-section of the light-blocking portions 23, and corresponds to a cross-sectional view taken along line C-C' in FIG. 5A. As shown in FIG. 6A, the inclined face 21*a* of the bottom portion 21 of the holder 20 and the inclined face 23*a* of each light-blocking portions 23 incline in the same orientation in the sub-scanning direction VD (X-axis direction).

It is assumed, as shown in FIG. 6B, that the inclination angle of the inclined face 21*a* of the bottom portion 21 of the holder 20 with respect to a face configured by the X-axis direction and the Y-axis direction (a face parallel with the bottom face 170*c* of the prism 170) is θ1. It is also assumed, as shown in FIG. 6C, that the inclination angle of the inclined face 23*a* of each light-blocking portion 23 with respect to a face configured by the X-axis direction and the Y-axis direction is θ2. In the present embodiment, the inclination angle θ1 and the inclination angle θ2 are the same angle, which is about 30 degrees, for example.

Ink Near-End Determination Method

Next, the ink near-end determination method according to the present embodiment will be described. FIGS. 7A and 7B and FIGS. 8A and 8B are diagrams illustrating the ink near-end determination method. FIGS. 7A and 7B show a cross-section in a YZ plane that passes through the prism 170 in each ink cartridge IC. FIGS. 7A and 7B each show a state where the positional relationship between the prism 170 and the detection portion 90 is a positional relationship (detection position) in which the amount of remaining ink can be detected for the ink near-end determination.

Figure 8A:
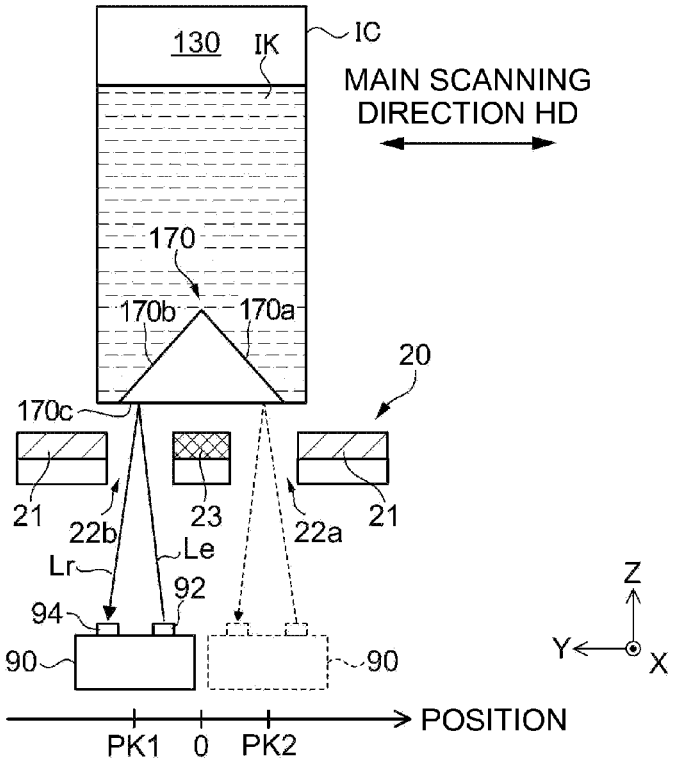
FIGS. 8A and 8B are diagrams illustrating the ink near-end determination method.
Figure 8B:
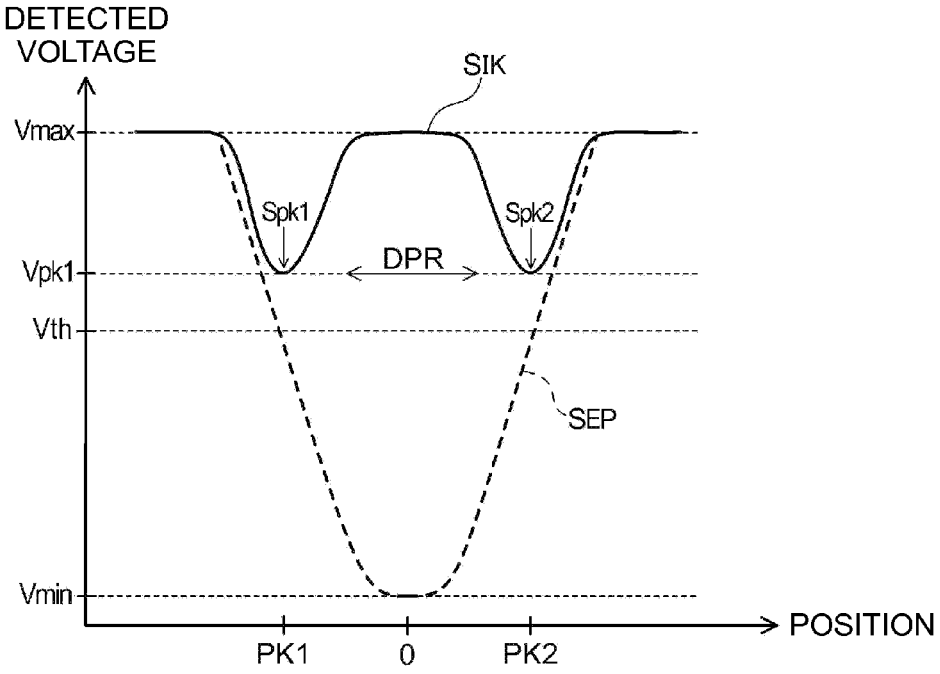

FIG. 8A shows a cross-section in a YZ plane that passes through the prism 170 in each ink cartridge IC. FIG. 8A shows a state where the positional relationship between the prism 170 and the detection portion 90 is not a positional relationship in which the amount of remaining ink can be detected for the ink near-end determination. FIG. 8B shows an exemplary characteristic of detection voltage when one of the ink cartridges IC passes above the detection portion 90.

As shown in FIG. 7A, the inclined faces 170*a* and 170*b* of the prism 170 face inward of the ink containing chamber 130. The inclined face 170*a* is a face perpendicular to the inclined face 170*b*, for example, and the inclined face 170*a* and the inclined face 170*b* are arranged symmetrically with respect to a plane parallel with an XZ plane. When the ink containing chamber 130 is filled with the ink IK, the inclined faces 170*a* and 170*b* are in contact with the ink IK.

When the ink cartridge IC is filled with the ink IK, radiated light Le entering the prism 170 from the light-emitting portion 92 enters the ink IK from the inclined face 170*a*. In this case, the amount of reflected light Lr reflected at the inclined faces 170*a* and 170*b* is very small, and accordingly the light-receiving portion 94 hardly receives the light. For example, assuming that the refractive index of the ink is 1.5, which is almost similar to the refractive index of water, if the prism 170 is made of polypropylene, the critical angle of total reflection at the inclined faces 170*a* and 170*b* is approximately 64 degrees. Since the incident angle is 45 degrees, the radiated light Le is not totally reflected at the inclined faces 170*a* and 170*b*, and enters the ink IK.

Suppose that, as shown in FIG. 7B, the ink IK in the ink cartridge IC is consumed for printing, and the ink cartridge IC is not filled with the ink IK. It is assumed that, of the inclined faces 170*a* and 170*b* of the prism 170, at least a part that the radiated light Le from the light-emitting portion 92 enters is in contact with the air. In this case, the radiated light Le entering the prism 170 from the light-emitting portion 92 is totally reflected at the inclined faces 170*a* and 170*b*, and exits as the reflected light Lr to the outside of the prism 170.

Accordingly, when the ink cartridge IC is not filled with the ink IK, the light-receiving portion 94 receives the totally reflected light Lr, and accordingly, strong detection voltage is obtained. For example, in a case where the refractive index of the air is 1 and the prism 170 is made of polypropylene, the critical angle of total reflection at the inclined faces 170*a* and 170*b* is approximately 43 degrees. Since the incident angle is 45 degrees, the radiated light Le entering the prism 170 is totally reflected at the inclined faces 170*a* and 170*b*.

In FIG. 8B, the horizontal axis indicates relative positions of the prism 170 and the detection portion 90, and the vertical axis indicates detection voltage that is output from the detection portion 90 at each position on the horizontal axis. The position at the time when the center of the prism 170 coincides with the center of the detection portion 90 (e.g., the positional relationship between the ink cartridge IC and the detection portion 90 shown in FIG. 7A) is "0" on the horizontal axis. The center of the detection portion 90 is the center between the light-emitting portion 92 and the light-receiving portion 94 in the main scanning direction HD.

A position PK1 is a position at which the relative positions of the center of the prism 170 and the center of the detection portion 90 are shifted from the position "0" in the main scanning direction HD, and that corresponds to the opening portion 22*b* of the holder 20, as in the positional relationship between the ink cartridge IC and the detection portion 90 shown in FIG. 8A. Similarly, a position PK2 is a position at which the relative positions of the center of the prism 170 and the center of the detection portion 90 are shifted from the position "0" in the main scanning direction HD, and that corresponds to the opening portion 22*a* of the holder 20.

As shown in FIG. 8B, the detection voltage approaches upper limit voltage Vmax as the amount of light received by the light-receiving portion 94 is closer to zero, and the detection voltage approaches lower limit voltage Vmin as the amount of light received by the light-receiving portion 94 is larger. When the amount of received light exceeds a predetermined value, the detection voltage is saturated and reaches the lower limit voltage Vmin. The upper limit voltage Vmax and the lower limit voltage Vmin correspond respectively to upper limit voltage and lower limit voltage in the range of voltage that the light-receiving portion 94 outputs to the collector terminal in FIG. 3, for example.

The detection voltage that is output from the detection portion 90 varies in accordance with the relative positions of the detection portion 90 and the prism 170. SIK indicates a detection voltage characteristic in the case where the ink cartridge IC is filled with the ink IK, as described in FIG. 7A. In this case, since the amount of light received by the light-receiving portion 94 is small, the detection voltage is close to Vmax at the position "0". At the positions PK1 and PK2 at which the relative positions of the center of the prism 170 and the center of the detection portion 90 are shifted from the position "0" in the main scanning direction HD, peaks Spk1 and Spk2 are respectively generated due to the reflected light Lr from the bottom face 170*c* of the prism 170. These peaks Spk1 and Spk2 will be described later.

SEP indicates a detection voltage characteristic in the case where the ink cartridge IC is not filled with the ink IK, as described in FIG. 7B. In this case, since the amount of light received by the light-receiving portion 94 is large, the detection voltage reaches Vmin (or approaches Vmin) at the position "0". Thus, the characteristic of the detection voltage significantly differs depending on whether or not the ink cartridge IC is filled with the ink IK. In the present embodiment, the ink near-end determination for each ink cartridge IC is performed by detecting this difference in the detection voltage characteristic.

Specifically, a threshold value Vth is set between a peak value Vpk1 and the lower limit voltage Vmin, based on the peak value Vpk1 of the detection voltage characteristic SIK. In a detection range DPR in which the ink cartridge IC passes above the detection portion 90, if the detection voltage of the detection portion 90 is smaller than the threshold value Vth, it is determined that the ink cartridge IC is in the ink near-end state. If the detection voltage is larger than or equal to the threshold value Vth, it is determined that the ink is remaining.

As shown in FIG. 8A, the light-blocking portion 23 that blocks the light from the light-emitting portion 92 is provided at the center of each opening portion 22 of the holder 20. A part of the radiated light Le entering the bottom face 170*c* of the prism 170 from the light-emitting portion 92 is reflected at the bottom face 170*c*, and is received as the reflected light Lr by the light-receiving portion 94. The reflection angle of this reflected light Lr at the bottom face 170*c* is equal to the incident angle of the radiated light Le at the bottom face 170*c*. As indicated by the detection voltage characteristic SIK in FIG. 8B, the reflected light Lr from the bottom face 170*c* is not detected at the position "0" since the light-blocking portion 23 is present, and the peaks Spk1 and Spk2 are detected respectively at the positions PK1 and PK2 since the light-blocking portion 23 is not present.

Here, the position PK1 is the position at which the center of the opening portion 22*b* and the center of the detection portion 90 in the main scanning direction HD coincide with each other, and the position PK2 is the position at which the center of the opening portion 22*a* and the center of the detection portion 90 in the main scanning direction HD coincide with each other. Note that, although the reflected light Lr from the bottom face 170*c* is also detected when totally reflected light returns from the prism 170, the peaks Spk1 and Spk2 are not generated since the detection voltage is buried in the signal of the totally reflected light, as indicated by the detection voltage characteristic SEP.

Position Correction Method

The positions of the ink cartridges IC are shifted due to various tolerances. Assumed tolerances include, for example, an inclination of the carriage CR, a shift in attachment thereof, an error of the rotary encoder, and a mechanical position shift due to a response speed of an electronic circuit (e.g., detection portion 90), such as driving of the carriage. The control unit 40 perceives the positions of the ink cartridges, based on the count value of the rotary encoder, and these positions perceived by the control unit 40 are shifted from the actual positions of the ink cartridges IC due to the olerances in some cases.

In a case of not correcting this position shift, it is necessary to consider a position shift range including all expected tolerances and determine a detection range DPR in FIG. 8B so as to be able to correctly perform the ink near-end detection within this position shift range. Then, the detection range DPR becomes wider than the interval between the two peaks Spk1 and Spk2, and the threshold value Vth cannot be set close to the peak voltage Vpk1 at the peaks Spk1 and Spk2.

Then, if the peak in the case indicated by SEP where the ink runs out is almost as large (Vpk1) as the peaks Spk1 and Spk2 caused due to the reflected light from the incident plane of the prism, the ink near-end state will not be able to be correctly detected using the threshold value Vth. This situation may occur when, for example, the amount of emitted light and the amount of received light decrease since an ink mist is attached to the detection portion 90, and the ratio (so-called S/N ratio) between noise including the peaks Spk1 and Spk2 and the detection voltage generated due to total reflection becomes small.

For this reason, in the present embodiment, the position of each ink cartridge IC perceived based on the count value of the rotary encoder is corrected based on the peaks Spk1 and Spk2 generated due to the reflected light (hereinafter referred to also as incident plane reflection) from the bottom face 170*c* of the prism 170. Since the position shift caused due to the tolerances is corrected by this correction, the position of each ink cartridge IC can be associated with a count value of the rotary encoder with high accuracy.

Figure 9:
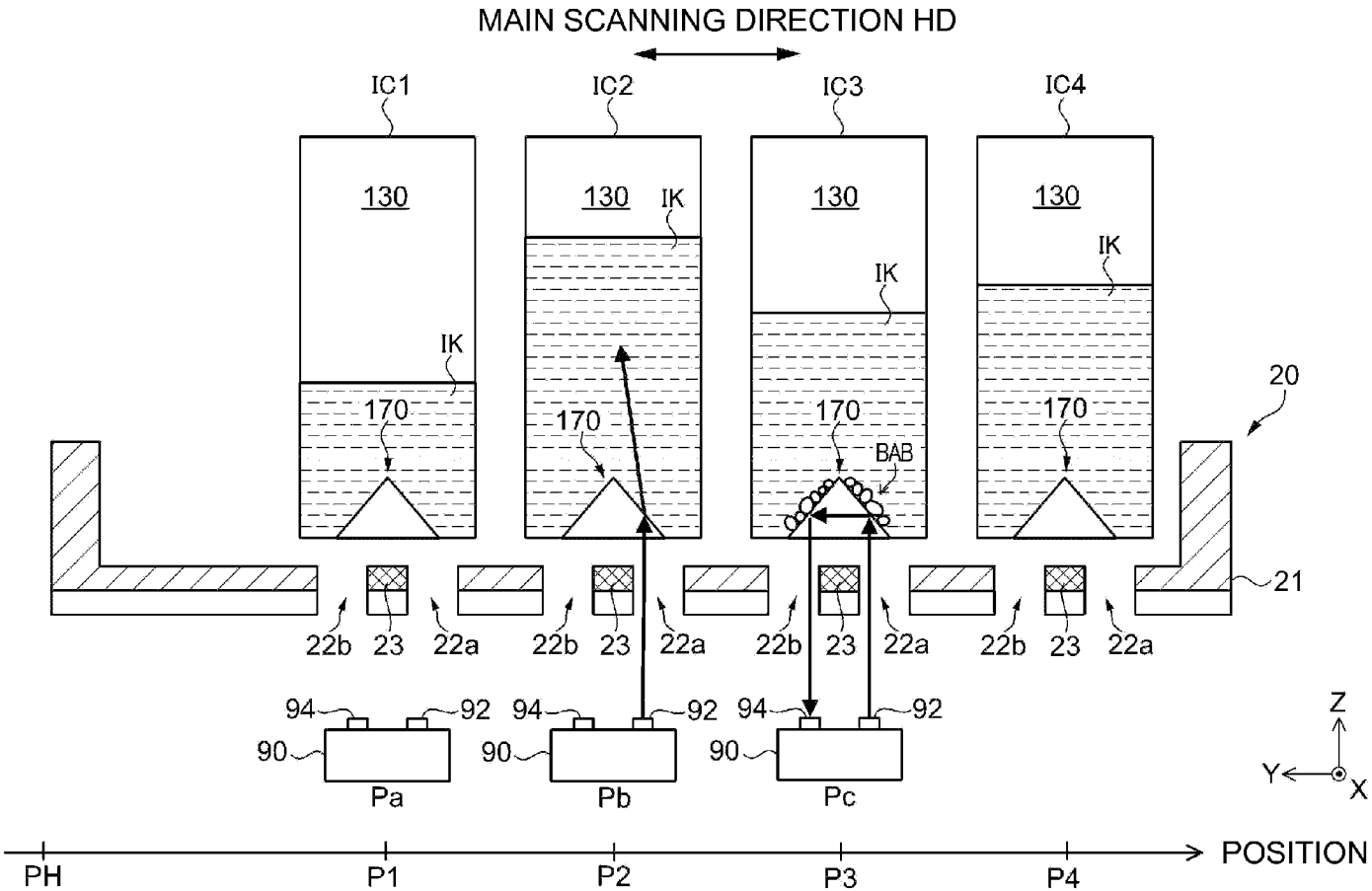
FIG. 9 is a diagram illustrating position correction processing.
Figure 10:
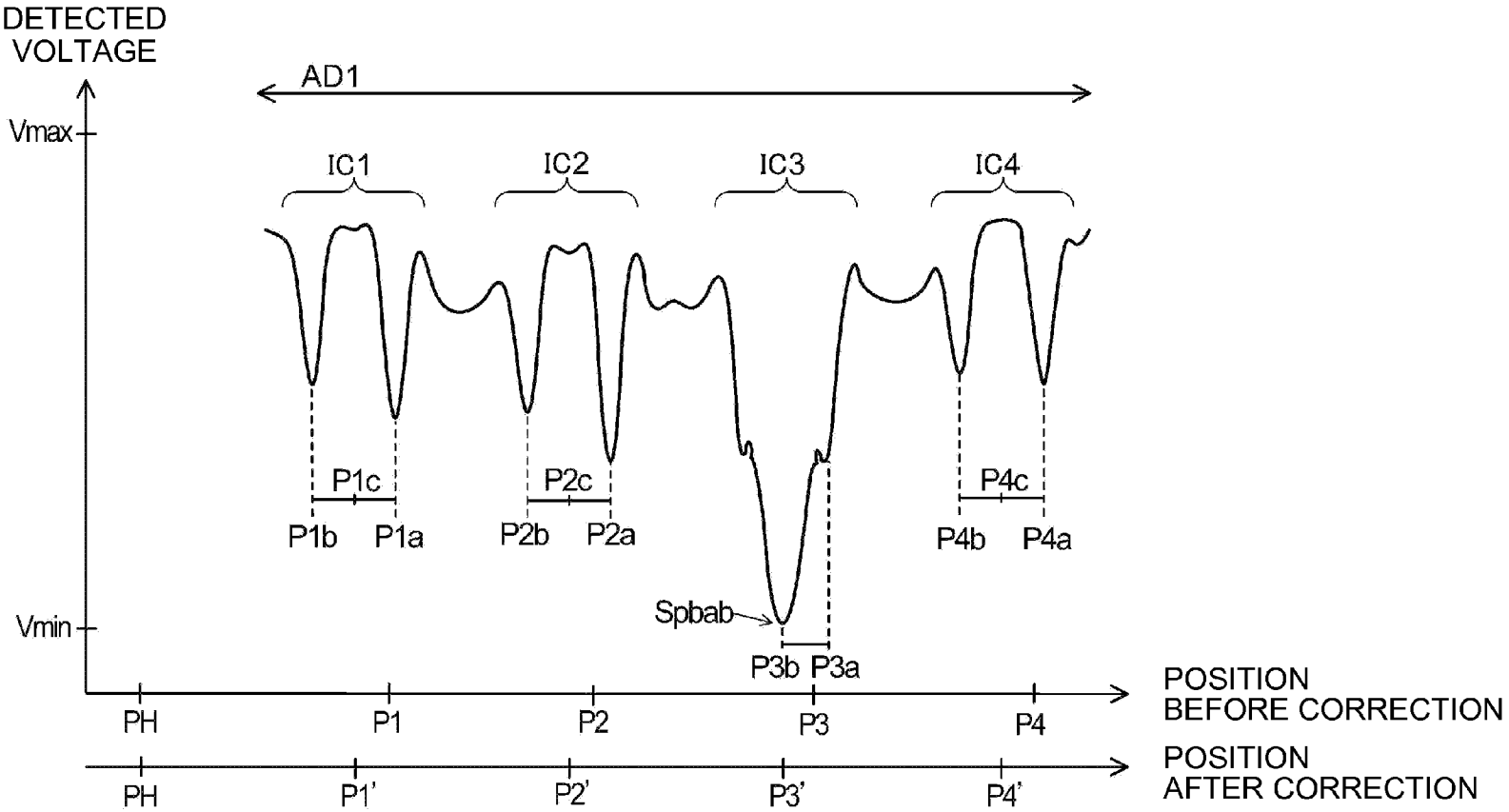
FIG. 10 is a diagram illustrating the position correction processing.

Next, the method for position correction processing in the present embodiment will be described in detail. FIGS. 9 and 10 are diagrams illustrating the position correction processing method. FIG. 9 shows the positional relationship between the detection portion 90 and the ink cartridges IC when the carriage CR has moved in the main scanning direction HD from the home position PH. Positions P1 to P4 are positions at which the prisms 170 in the respective ink cartridges IC1 to IC4 are irradiated with the light from the light-emitting portion 92. For example, the ink cartridges IC1 to IC4 are filled with cyan ink, magenta ink, yellow ink, and black ink, respectively, and the ink near-end detection is performed for each ink cartridge IC.

These positions P1 to P4 correspond to respective count values of the rotary encoder, and the count values based on a design value of the carriage CR are stored in the EEPROM (not shown). In the position correction processing, the count values P1 to P4 are corrected, and count values P1' to P4' after the correction are obtained. At the time of the ink near-end determination, information (count values) for specifying the positions P1' to P4' is referred to as detection position information.

It is assumed that these positions P1 to P4 are shifted from the actual ink cartridges IC1 to IC4 due to various tolerances as mentioned above. In the present embodiment, correction processing is performed on the positions P1 to P4 with position shifts, and processing is performed for storing the count values corresponding to the positions after the correction, as corrected detection position information, in the RAM in the control unit 40 (see FIG. 2).

FIG. 10 shows an exemplary detection voltage characteristic at the positions P1 to P4 when the carriage CR has moved in the main scanning direction HD from the home position PH. As shown in FIG. 10, the position correction portion 44 (see FIG. 2) sets a position range AD1 for acquiring the detection voltage of the ink cartridges IC1 to IC4, based on the positions before the correction, and obtains the detection voltage at the time when the carriage CR passes through the position range AD1.

The position correction portion 44 performs peak detection processing on the detection voltage of each ink cartridge IC, and detects a first peak at which the peak voltage is smallest, and a second peak at which the peak voltage is second smallest. Taking the ink cartridge IC1 as an example, the position correction portion 44 detects the first peak at a position P1*a* and the second peak at a position P1*b*, and obtains the center P1*c* (average value of P1*a* and P1*b*) of these peaks. The position correction portion 44 also obtains the center positions P2*c* and P4*c* respectively for the ink cartridges IC2 and IC4, obtains differences P1–P1*c*, P2–P2*c*, and P4–P4*c*, and obtains an average value (correction value) of these differences. The average value of the differences is added to P1 to P4 to obtain the ultimate corrected positions P1' to P4' of the ink cartridges IC1 to IC4.

Here, there are cases where an air bubble BAB is attached to the prism 170, as in the ink cartridge IC3 in FIG. 9. For example, an air bubble is attached to the prism 170 when the user drops the ink cartridge IC onto the floor, and if this ink cartridge IC is installed as-is into the holder 20, the detection voltage is sampled with the air bubble attached. If an air bubble is attached to the prism 170, the prism 170 comes in contact with the air even when the ink cartridge IC is filled with the ink IK, and accordingly a part of the incident light is totally reflected.

Then, a peak Spbab is generated due to the air bubble, as indicated by the detection voltage of the ink cartridge IC3 in FIG. 10. The level of the peak Spbab varies depending on the amount and position of the attached air bubble BAB, and becomes larger than the peak generated due to incident plane reflection in some cases. In such cases, the center position of peaks generated due to incident plane reflection cannot be calculated in the position correction processing. Accordingly, if it is determined that the air bubble BAB is attached to the ink cartridge IC, this ink cartridge IC is excluded from the target of the aforementioned correction value calculation.

Specifically, taking the ink cartridge IC3 in FIG. 10 as an example, in the peak detection, the peak Spbab is detected as the peak with the smallest peak voltage, and one of the peaks generated due to incident face reflection is detected as the peak with the second smallest peak voltage. If an interval P3*b*-P3*a* between these two peaks is smaller than a predetermined value, it is determined that an air bubble is attached, the center position of the peaks is not calculated, and the ink cartridge IC3 is excluded from the target of the aforementioned correction value calculation.

As described above, with the configuration of the printer 10 according to the present embodiment, even if a position shift occurs in the detection position of each prism 170 with respect to the detection portion 90, the position shift can be corrected with high accuracy. Thus, the range DPR in which the ink near-end state is detected can be set narrower as compared with the case of not performing position correction, and accordingly the ink near-end determination can be performed with higher accuracy.

Furthermore, with the configuration of the printer 10 according to the present embodiment, in a state where the ink cartridges IC1 to IC4 are installed in the holder 20, the light-blocking portions 23 are provided in the opening portions 22 arranged at the positions facing the bottom face 170*c* of the respective prisms 170 in the bottom portion 21 of the holder 20. For this reason, the reflected light from the bottom face 170*c* is not detected at the position "0", and accordingly, the first peak Spk1 and the second peak Spk2 can be generated in the detection voltage (detection voltage characteristic SIK). Thus, the detection position information can be corrected by detecting the first peak Spk1 and the second peak Spk2 and calculating the center position (average value) of these two peaks.

Note that the detection position may be corrected during both forward movement and backward movement. Here, "forward movement" means movement in which the relative positions of the carriage CR and the detection portion 90 move away from each other, and "backward movement" means movement in which the relative positions of the carriage CR and the detection portion 90 approach each other. Although the response speed of circuits (e.g., of the phototransistor etc.) in the light-receiving portion 94 differs during the forward movement and during the backward movement, a position shift occurring due to this difference in the response speed can be corrected by correcting the detection position information during both the forward movement and the backward movement.

Ink Near-End Determination Processing and Position Correction Processing

Figure 11:
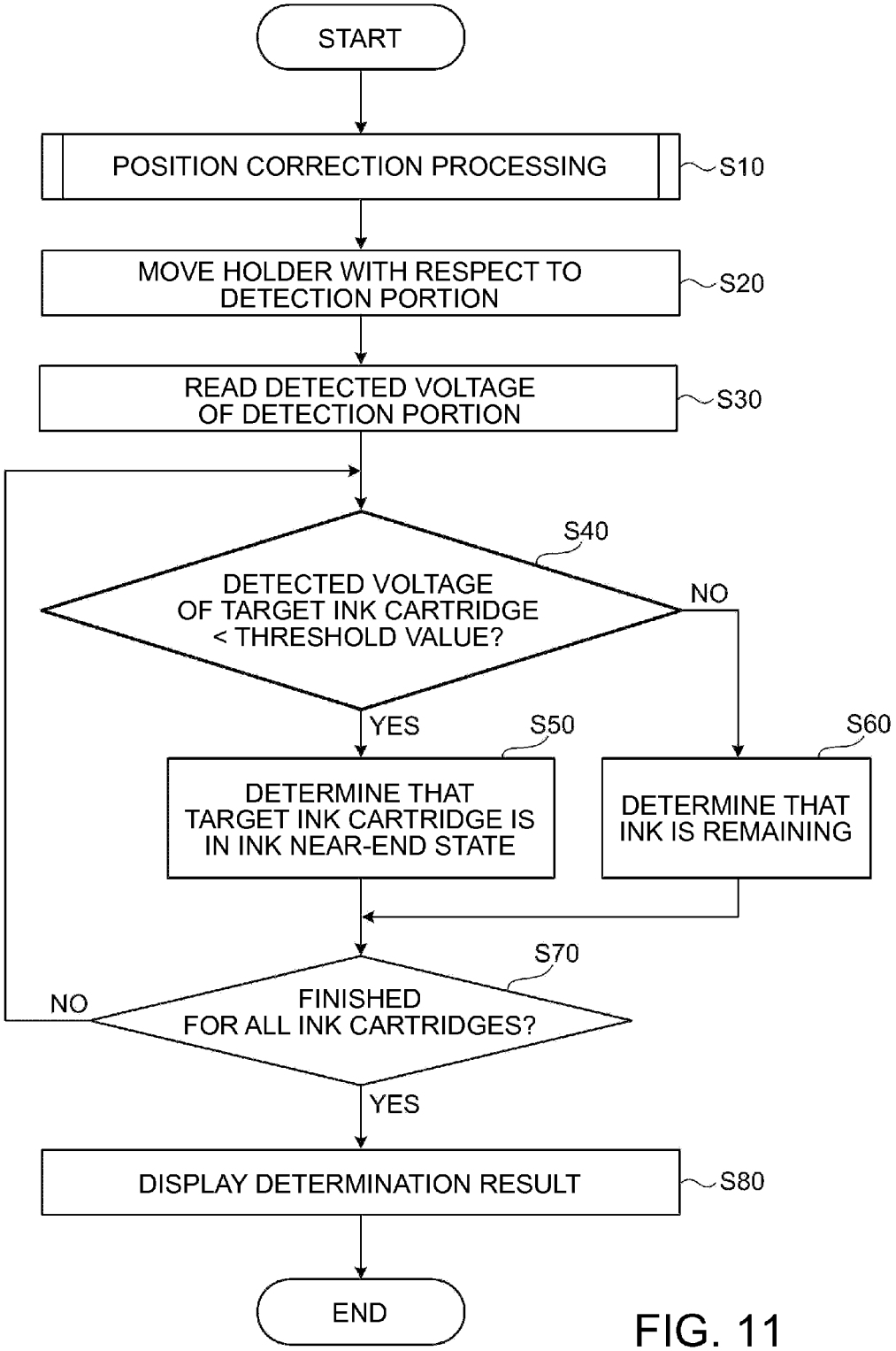
FIG. 11 is a flowchart showing ink near-end determination processing.
Figure 12:
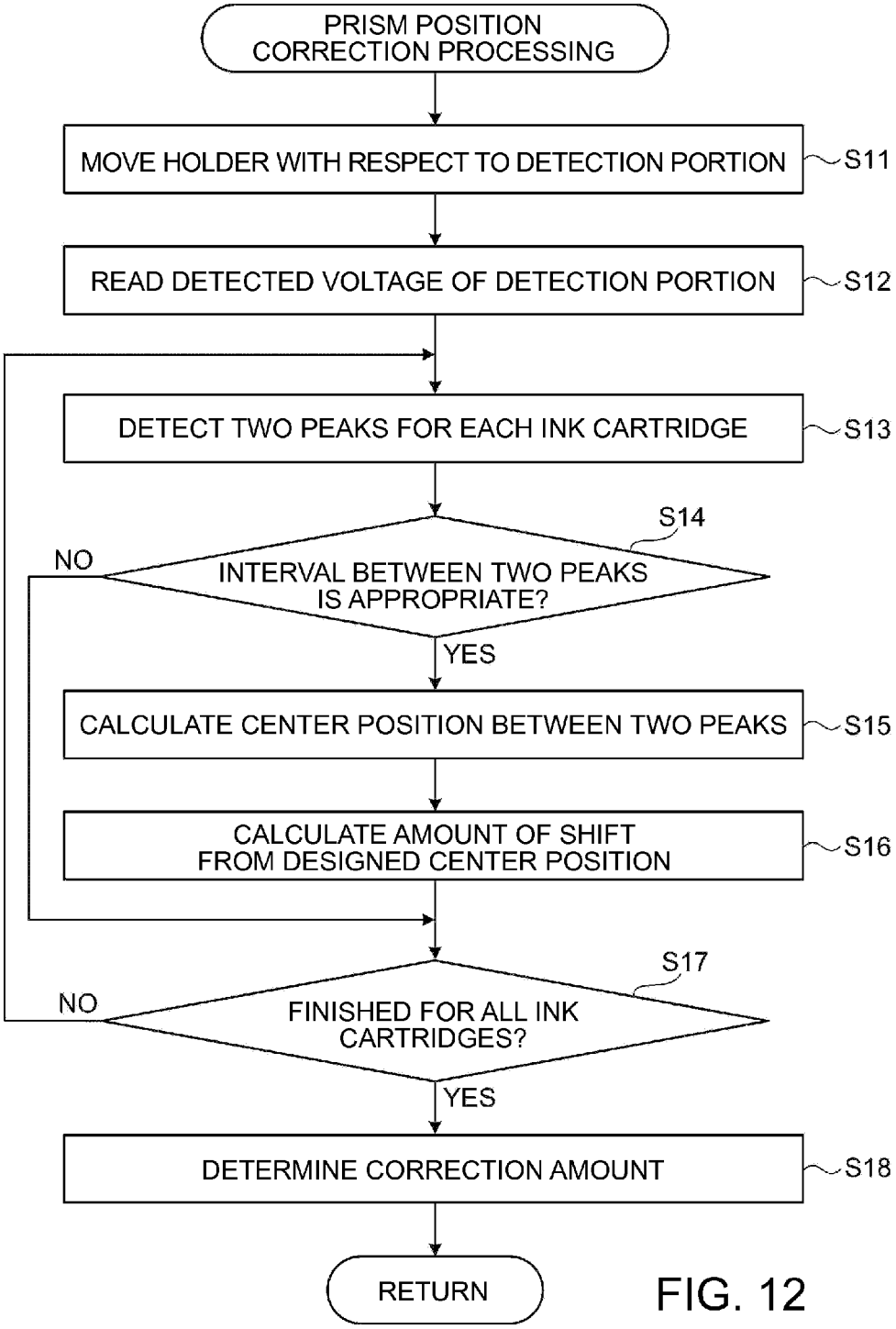
FIG. 12 is a flowchart showing the position correction processing.

Next, a description will be given of procedure of the ink near-end determination processing and the position correction processing in the printer 10 according to the present embodiment. FIG. 11 is a flowchart showing the ink near-end determination processing. FIG. 12 is a flowchart showing the position correction processing. The ink near-end determination processing and the position correction processing are executed when the printer 10 is started, or at the time of replacement of the ink cartridges IC, for example.

As shown in FIG. 11, in the ink near-end determination processing, initially, the control unit 40 (position correction portion 44) performs position correction processing in the main scanning direction HD for each of the prisms 170 in the ink cartridges IC1 to IC4 (step S10).

The details of the position correction processing for each prism 170 will now be described. The control unit 40 causes the carriage CR to scan from the home position PH in the main scanning direction HD, and moves the relative position of the holder 20 (ink cartridges IC) with respect to the detection portion 90 (step S11). In step S11, the control unit 40 causes the reflected light that is radiated by the light-emitting portion 92 and is reflected at the prisms 170 in the ink cartridges IC1 to IC4 to be received by the light-receiving portion 94 at the positions P1 to P4 before the correction shown in FIG. 9.

Subsequently, the control unit 40 reads the detection voltage (output voltage Vc) of the detection portion 90 (light-receiving portion 94) corresponding to the amount of the reflected light from the prisms 170 in the ink cartridges IC1 to IC4 at the positions P1 to P4 (step S12). As a result of step S12, a detection voltage waveform shown in FIG. 10 is obtained.

Subsequently, the control unit 40 detects two peaks for each of the ink cartridges IC1 to IC4, from the detection voltage waveform obtained in step S12 (step S13). Then, the control unit 40 determines whether or not the interval between the two peaks detected in step S13 in association with a target ink cartridge IC is appropriate (step S14).

If it is determined that the interval between the two peaks is appropriate (step S14: YES), the control unit 40 calculates the center position (average value) of the two peaks corresponding to the target ink cartridge IC (step S15). The control unit 40 then calculates the amount of a shift from the designed center position, based on the calculated center position (average value) (step S16).

On the other hand, if it is determined in step S14 that the interval between the two peaks is not appropriate (step S14: NO), the control unit 40 does not calculate the center position of the peaks for the target ink cartridge IC, and advances the processing to step S17.

In step S17, it is determined whether or not the processing up to step S16 has finished for all ink cartridges IC1 to IC4. If it is determined that the processing has finished for all ink cartridges IC (step S17: YES), the control unit 40 determines the correction amount for correcting the detection position information, based on the amount of the shift from the designed center position calculated for each ink cartridge IC (step S18). The control unit 40 then advances the processing to step S20 in FIG. 11.

On the other hand, if it is determined in step S17 that the processing has not finished for all ink cartridges IC (step S17: NO), the control unit 40 returns the processing to step S13.

Next, returning to the flowchart in FIG. 11, in step S20, the control unit 40 moves the holder 20 in the main scanning direction HD such that each of the prisms 170 in the ink cartridges IC1 to IC4 passes above the detection portion 90. Here, the control unit 40 causes the reflected light that is radiated from the light-emitting portion 92 and is reflected at the prisms 170 in the ink cartridges IC1 to IC4 to be received by the light-receiving portion 94 at the positions P1' to P4' (see FIG. 10) after the correction based on the correction amount determined in step S18.

Subsequently, the control unit 40 reads the detection voltage (output voltage Vc) of the detection portion 90 (light-receiving portion 94) corresponding to the amount of the reflected light from the prisms 170 in the ink cartridges IC1 to IC4 in a detection range including the positions P1' to P4' after the correction (step S30).

Next, the control unit 40 (remaining amount determination portion 42) compares the detection voltage of the determination target ink cartridge IC with the threshold value of the detection voltage for the ink near-end determination, based on a result of the detection voltage measurement in step S30 (step S40).

If the detection voltage of the determination target ink cartridge IC is smaller than this threshold value (step S40: YES), the control unit 40 determines that the determination target ink cartridge IC is in the "ink near-end" state (step S50). On the other hand, if the detection voltage of the determination target ink cartridge IC is not smaller than the threshold value (step S40: NO), the control unit 40 determines that "ink is remaining" in the determination target ink cartridge IC (step S60).

Next, the control unit 40 determines whether or not the ink near-end determination has finished for all ink cartridges IC1 to IC4 (step S70). If the ink near-end determination has finished for all ink cartridges IC (step S70: YES), the control unit 40 displays the amount of remaining ink in the ink cartridges IC1 to IC4 (whether or not the ink cartridges IC1 to IC4 are in the ink near-end state), on the display unit 46 provided in the printer 10 and the computer 48 connected to the printer 10 (step S80).

On the other hand, if any ink cartridge IC remains for which the ink near-end determination has not finished (step S70: NO), the processing returns to step S40, and the ink near-end determination is performed for the remaining ink cartridge IC. Thus, it is sequentially determined whether or not the ink cartridges IC1 to IC4 are in the ink near-end state.

Effect of Inclined Faces

Figure 13A:
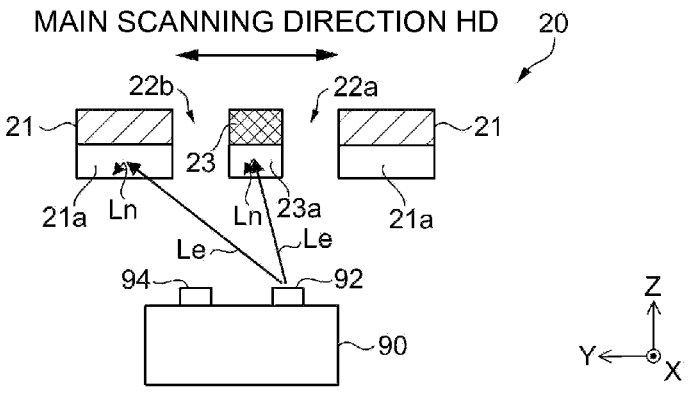
FIGS. 13A to 13C are diagrams illustrating reflected light at the inclined faces according to the first embodiment.
Figure 13B:
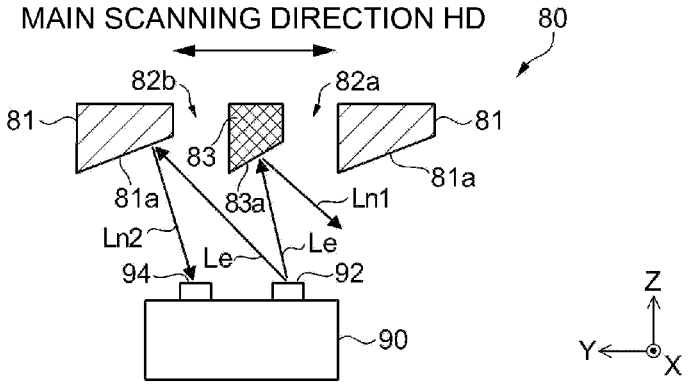
Figure 13C:
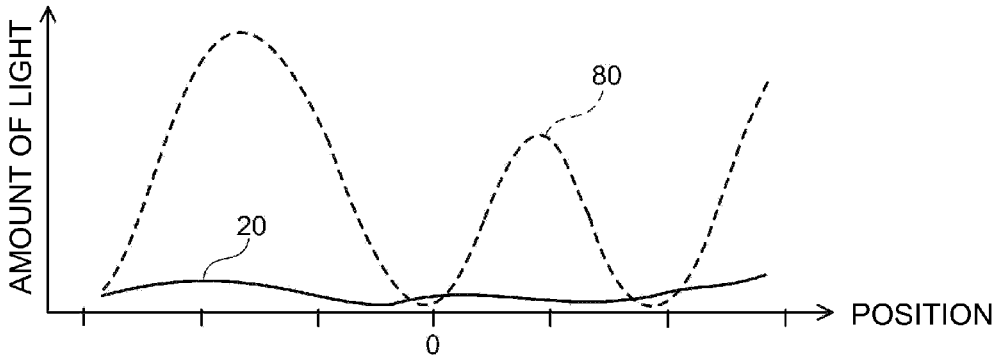

Next, a description will be given of the effect of the inclined face 21*a* provided in the bottom portion 21 of the holder 20 of the printer 10, and of the inclined face 23*a* provided in each light-blocking portion 23, according to the first embodiment. FIGS. 13A to 13C are diagrams illustrating the reflected light at the inclined faces according to the first embodiment. FIG. 13A shows a cross-section in a YZ plane that passes through the holder 20 in the present embodiment. FIG. 13B shows a cross-section in a YZ plane that passes through a known holder 80 in a comparative example. FIG. 13C is a diagram for comparison of the reflected light from the holder, between the holder 20 in the present embodiment and the known holder 80.

In the holder 20 in the present embodiment shown in FIG. 13A, as described above, the inclined face 21*a* that inclines in the X-axis direction is provided in the bottom portion 21, and the inclined face 23*a* that inclines in the X-axis direction are provided in each light-blocking portion 23. The light-emitting portion 92 and the light-receiving portion 94 provided in the detection portion 90 are arranged so as to be aligned with the main scanning direction HD (Y-axis direction) in which the holder 20 moves.

As described above, the printer 10 according to the present embodiment has a configuration in which the ink near-end determination for each ink cartridge IC and the position correction are performed based on the intensity of the reflected light Lr from the prism 170 (inclined face 170*a* or 170*b*, or bottom face 170*c*) received by the light-receiving portion 94. For this reason, if the light-receiving portion 94 receives the reflected light (hereinafter referred to as "noise light Ln") that is reflected at a portion other than the prism 170, such as the bottom portion 21 of the holder 20 or the bottom face of the light-blocking portion 23, it will decrease the accuracy of the ink near-end determination processing and the position correction processing.

In a case where the light-emitting device provided in the light-emitting portion 92 has a relatively wide directional angle, the radiated light Le that is radiated from the light-emitting portion 92 includes not only the radiated light Le that travels in the +Z direction as shown in FIGS. 7A and 7B, but also the radiated light Le that obliquely travels in a direction other than the +Z direction as shown in FIG. 13A. Accordingly, light that is reflected at the bottom portion 21 of the holder 20 or the light-blocking portion 23 and becomes the noise light Ln is generated from the radiated light Le that is radiated from the light-emitting portion 92.

The holder 80 shown in FIG. 13B that is an exemplary known holder has, in a light-blocking portion 83 thereof, an inclined face 83*a* that inclines in the Y-axis direction, as in the printer described in JP-A-2013-99890. Inclined faces 81*a* that incline in the Y-axis direction are also provided in a bottom portion 81 of the holder 80. Radiated light Le entering the inclined faces 81*a* and the inclined face 83*a* is reflected at a reflection angle that is equal to the incident angle at the inclined face 81*a* and the inclined face 83*a*, while the normal direction of the inclined faces 81*a* and the inclined face 83*a* is different from the Z-axis direction. For this reason, most of the noise light Ln travels in a direction other than the direction toward the light-receiving portion 94, as noise light Ln1 reflected at the inclined face 83*a* of the light-blocking portion 83 shown in FIG. 13B does.

However, since the inclined faces 81*a* and the inclined face 83*a* incline in the Y-axis direction, which is the same as the direction in which the light-emitting portion 92 and the light-receiving portion 94 are arranged, the noise light, such as noise light Ln2 reflected at the inclined face 81*a* shown in FIG. 13B, may possibly be received by the light-receiving portion 94, depending on the angle of the radiated light Le that is radiated from the light-emitting portion 92.

In contrast, in the holder 20 in the present embodiment shown in FIG. 13A, the inclined face 21*a* of the bottom portion 21 and the inclined face 23*a* of each light-blocking portion 23 incline in the X-axis direction that intersects the direction in which the light-emitting portion 92 and the light-receiving portion 94 are arranged. For this reason, the noise light Ln reflected at the inclined face 21*a* and the inclined face 23*a* travels in a direction other than the direction toward the light-receiving portion 94, and accordingly the noise light Ln to be received by the light-receiving portion 94 can be significantly reduced, as compared with the known holder 80.

FIG. 13C shows comparison between the amounts of the noise light Ln reflected at the holders 20 and 80 and received by the light-receiving portion 94 when the holders 20 and 80 were caused to scan in the main scanning direction HD (Y-axis direction) with respect to the detection portion 90. As shown in FIG. 13C, with the known holder 80, peaks are found at which the noise light Ln increases due to the relative position of the holder 80. In contrast, with the holder 20 in the present embodiment, such peaks are not found, and the amount of the noise light Ln is smaller than that in the case of the known holder 80, regardless of the relative position of the holder 20.

As described above, in the holder 20 of the printer 10 according to the first embodiment, the bottom portion 21 and each light-blocking portion 23 respectively have the inclined face 21*a* and the inclined face 23*a* that incline in the X-axis direction. Accordingly, the noise light Ln that is reflected at the inclined face 21*a* and the inclined face 23*a* and received by the light-receiving portion 94 can be reduced. Thus, with the printer 10, the accuracy of the ink near-end determination processing and the position correction processing can be improved, as compared with a printer including the known holder 80.

Note that, although the inclination angle θ1 of the inclined face 21*a* and the inclination angle θ2 of the inclined face 23*a* are about 30 degrees in the present embodiment, the inclination angles θ1 and θ2 may be an angle other than 30 degrees, and the inclination angle θ1 and the inclination angle θ2 may be different from each other.

Second Embodiment

Figure 14A:
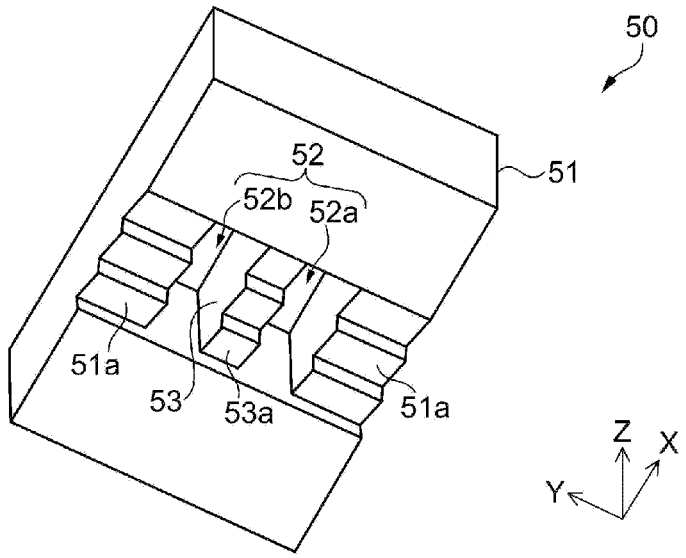
FIGS. 14A to 14C are diagrams illustrating inclined faces of a holder according to a second embodiment.
Figure 14B:
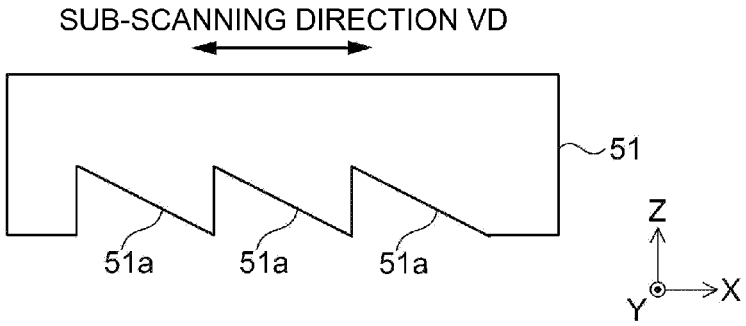
Figure 14C:
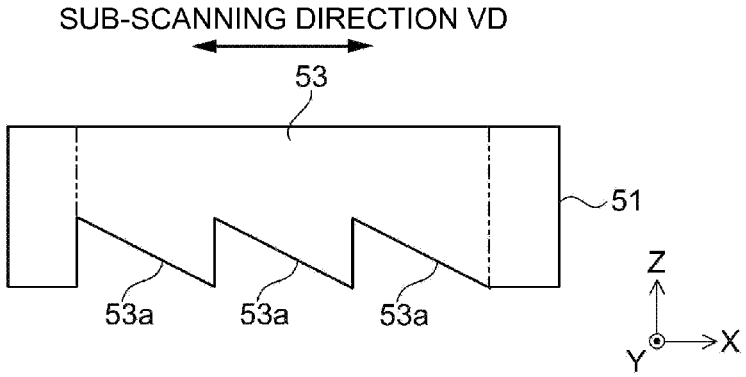

A printer according to a second embodiment has a configuration that is almost similar to that of the first embodiment, except that the holder has a different configuration. A difference from the holder 20 in the first embodiment will be described here. FIGS. 14A to 14C are diagrams illustrating inclined faces of the holder according to the second embodiment. FIG. 14A shows a holder 50 according to the second embodiment, and corresponds to an enlarged perspective view of the part D in FIG. 5A. FIG. 14B is a schematic view of an XZ cross-section of a bottom portion 51, and corresponds to a cross-sectional view taken along line B-B' in FIG. 5A. FIG. 14C is a schematic view of an XZ cross-section of a light-blocking portion 53, and corresponds to a cross-sectional view taken along line C-C' in FIG. 5A. The same constituent elements as those in the first embodiment will be given the same reference numerals, and descriptions thereof will be omitted.

Configuration and Effect of Holder

As shown in FIG. 14A, the holder 50 according to the second embodiment has, in the bottom portion 51, a plurality of inclined faces 51*a* that incline in the sub-scanning direction VD (X-axis direction). The holder 50 also has a light-blocking portion 53 that divides, in the sub-scanning direction VD (X-axis direction), an opening portion 52 into two parts, namely an opening portion 52*a* and an opening portion 52*b*, and the light-blocking portion 53 has a plurality of inclined faces 53*a* that incline in the sub-scanning direction VD (X-axis direction).

As shown in FIG. 14B, the bottom portion 51 has, for example, three inclined faces 51*a* that are provided so as to be arranged in a saw blade-like shape in the X-axis direction. The length and the inclination angle of the inclined faces 51*a* in the X-axis direction are substantially the same. As shown in FIG. 14C, the light-blocking portion 53 also has, for example, three inclined faces 53*a* that are provided so as to be arranged in a saw blade-like shape in the X-axis direction. The length and the inclination angle of the inclined faces 53*a* in the X-axis direction are substantially the same. Note that, although the orientation in which the inclined faces 51*a* and the inclined faces 53*a* incline is opposite, in the X-axis direction, to the orientation in which the inclined face 21*a* and the inclined face 23*a* (FIGS. 6B and 6C) in the first embodiment incline, these orientations may be the same.

Figure 15A:
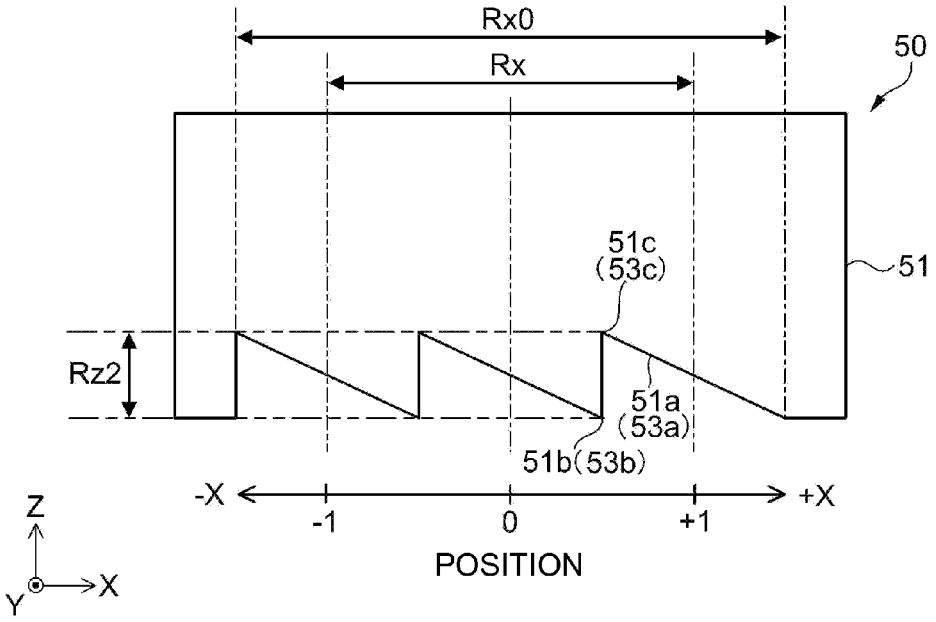
FIGS. 15A and 15B are diagrams illustrating an effect of the holder according to the second embodiment.

A description will now be given of an effect to be achieved by providing the plurality of inclined faces 51*a* and inclined faces 53*a* arranged in a saw blade-like shape, as in the holder 50 according to the second embodiment. FIGS. 15A and 15B and FIGS. 16A to 16D are diagrams illustrating an effect of the holder according to the second embodiment. FIG. 15A shows an XZ cross-section of the bottom portion 51 of the holder 50, as in FIG. 14B. A detection portion 90 (not shown) is arranged on the side where the inclined faces 51*a* of the bottom portion 51 are provided.

In FIG. 15A, it is assumed that the three inclined faces 51*a* provided in the bottom portion 51 are arranged in a range Rx0 in the X-axis direction. The position "0" on the horizontal axis is the position of the holder 50 corresponding to the designed center position of the detection portion 90 in the sub-scanning direction VD (X-axis direction). It is assumed that the relative position of the detection portion 90 with respect to the holder 50 may possibly be shifted within a range Rx, namely, from the position "0" to the position "+1" in the +X direction, and to the position "−1" in the −X direction, for example.

As shown in FIG. 15A, with the holder 50 according to the second embodiment, the distance between the detection portion 90 and the inclined faces 51*a* in the Z-axis direction in the range Rx in the X-axis direction varies within a range Rz2. It is assumed that the lowermost point of the inclined faces 51*a* of the bottom portion 51 in the −Z direction in the range Rx in the X-axis direction is 51*b*, and the uppermost point thereof is 51*c*. The XZ cross-section of the light-blocking portion 53 has a shape similar to the XZ cross-section of the bottom portion 51, and it is assumed that the lowermost point of the inclined faces 53*a* of the light-blocking portion 53 in the −Z direction in the range Rx in the X-axis direction is 53*b*, and the uppermost point thereof is 53*c*.

Figure 15B:
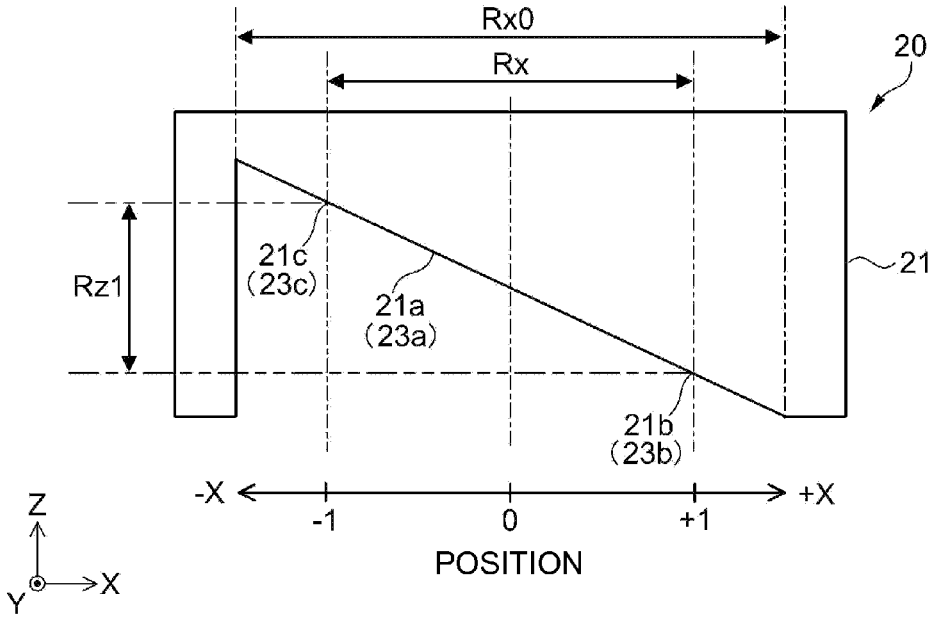

FIG. 15B shows, similarly to FIG. 6B, the XZ cross-section of the bottom portion 21 of the holder 20 according to the first embodiment, for comparison. It is assumed that the inclined face 21*a* provided in the bottom portion 21 of the holder 20 is arranged in the range Rx0 in the X-axis direction. In the holder 20, the distance between the detection portion 90 and the inclined face 21*a* in the Z-axis direction in the range Rx varies within a range Rz1. It is assumed that the lowermost point of the inclined face 21*a* of the bottom portion 21 in the −Z direction in the range Rx in the X-axis direction is 21*b*, and the uppermost point thereof is 21*c*. The XZ cross-section of the inclined face 23*a* of each light-blocking portion 23 also has a shape similar to the XZ cross-section of the bottom portion 21, and it is assumed that the lowermost point of the inclined face 23*a* of each light-blocking portion 23 in the −Z direction in the range Rx in the X-axis direction is 23*b*, and the uppermost point thereof is 23*c*.

Here, assuming that the inclination angle of the inclined faces 51*a* is the same as the inclination angle of the inclined face 21*a*, a range Rz2 shown in FIG. 15A is smaller than the range Rz1 shown in FIG. 15B. The distances between the lowermost point 51*b* of the inclined faces 51*a* and the detection portion 90 in the Z-axis direction, and the distance between the uppermost point 51*c* to the detection portion 90 in the Z-axis direction shown in FIG. 15A are respectively smaller than the distance between the lowermost point 21*b* of the inclined face 21*a* and the detection portion 90 in the Z-axis direction, and the distance between the uppermost point 21*c* and the detection portion 90 in the Z-axis direction shown in FIG. 15B.

Figure 16B:
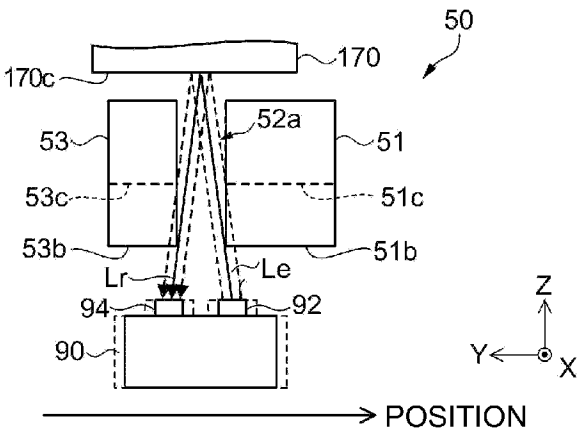
FIGS. 16A to 16D are diagrams illustrating an effect of the holder according to the second embodiment.
Figure 16A:
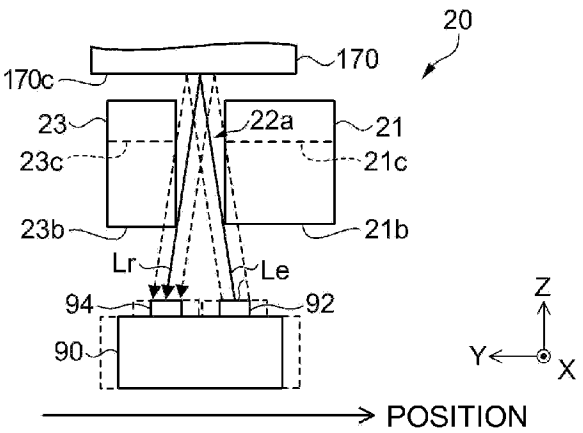

In FIG. 16A, a YZ cross-section of the inclined face 21*a* of the holder 20 (bottom portion 21) according to the first embodiment at the position "+1" is indicated by solid lines, and a YZ cross-section thereof at the position "−1" is indicated by broken lines. As shown in FIG. 16A, the radiated light Le that is radiated from the light-emitting portion 92 passes through the opening portion 22*a* of the holder 20 and reflected at the bottom face 170*c* of the prism 170 is received as the reflected light Lr by the light-receiving portion 94. In other words, the radiated light Le that is radiated from the light-emitting portion 92 and is then blocked by the bottom portion 21 does not enter the bottom face 170*c* of the prism 170. Also, the reflected light Lr that is reflected at the bottom face 170*c* and is then blocked by the light-blocking portion 23 is not received by the light-receiving portion 94.

Comparing a case where the holder 20 is relatively shifted to the position "+1" in the +X direction with respect to the detection portion 90 (lowermost point 21*b* indicated by solid lines) with a case where the holder 20 is relatively shifted to the position "−1" in the −X direction (uppermost point 21*c* indicated by broken lines), the distance between the uppermost point 21*c* of the bottom portion 21 and the detection portion 90 in the Z-axis direction is larger than the distance between the lowermost point 21*b* and the detection portion 90 in the Z-axis direction. Accordingly, less radiated light Le is blocked by the bottom portion 21 in the case indicated by broken lines where the holder 20 is relatively shifted to the position "−1" in the −X direction, and accordingly more radiated light Le enters the bottom face 170*c* of the prism 170.

Similarly, the distance between the uppermost point 23*c* of the light-blocking portion 23 and the detection portion 90 in the Z-axis direction is larger than the distance between the lowermost point 23*b* and the detection portion 90 in the Z-axis direction. Accordingly, less reflected light Lr is blocked by the light-blocking portion 23 in the case indicated by broken lines where the holder 20 is relatively shifted to the position "−1" in the −X direction, and accordingly more reflected light Lr is received by the light-receiving portion 94.

In FIG. 16B, a YZ cross-section of the holder 50 (bottom portion 51) and the light-blocking portion 53 according to the second embodiment at the position "+1" is indicated by solid lines, and a YZ cross-section thereof at the position "−1" is indicated by broken lines. In the holder 50, the uppermost point 51*c* of the bottom portion 51 is further on the side in the −Z direction than the uppermost point 21*c* of the bottom portion 21 shown in FIG. 16A, and accordingly, the distance between the uppermost point 51*c* and the detection portion 90 in the Z-axis direction is smaller than the distance between the uppermost point 21*c* and the detection portion 90 in the Z-axis direction.

Since the lowermost point 51*b* of the bottom portion 51 is further on the side in the −Z direction than the lowermost point 21*b* of the bottom portion 21 shown in FIG. 16A, the distance between the lowermost point 51*b* and the detection portion 90 in the Z-axis direction is also smaller than the distance between the lowermost point 21*b* and the detection portion 90 in the Z-axis direction. Regarding the light-blocking portion 53 as well, the uppermost point 53*c* and the lowermost point 53*b* shown in FIG. 16B are further on the side in the −Z direction than the uppermost point 21*c* and the lowermost point 21*b* shown in FIG. 16A, respectively. Accordingly, the distance between the uppermost point 53*c* and the detection portion 90 in the Z-axis direction and the distance between the lowermost point 53*b* and the detection portion 90 in the Z-axis direction are smaller. Accordingly, with the holder 50 according to the second embodiment, the amount of the radiated light Le entering the bottom face 170*c* of the prism 170 is smaller, and the amount of the reflected light Lr received by the light-receiving portion 94 is also smaller, as compared with the case of the holder 20 according to the first embodiment.

Furthermore, since the range Rz2 (see FIG. 15A) is smaller than the range Rz1 (see FIG. 15B), the distance between the uppermost point 51*c* and the lowermost point 51*b* of the holder 50 in the Z-axis direction and the distance between the uppermost point 53*c* and the lowermost point 53*b* in the Z-axis direction are smaller than those in the case of the holder 20 according to the first embodiment. For this reason, the difference in the amount of the radiated light Le entering the bottom face 170*c* of the prism 170 and of the reflected light Lr received by the light-receiving portion 94 between the case where the holder 50 is shifted to the position "+1" in the +X direction and the case where the holder 50 is shifted to the position "−1" in the −X direction is smaller than that in the case of the holder 20 according to the first embodiment.

Figure 16D:
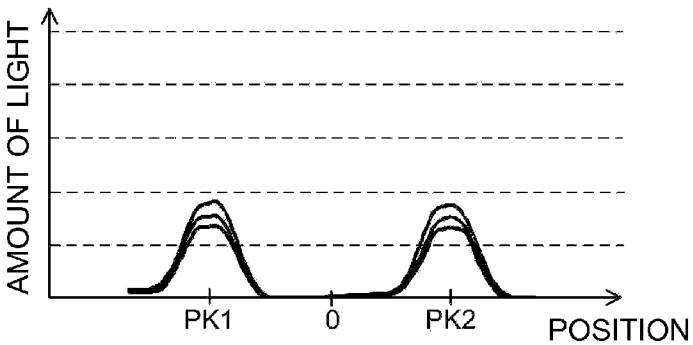
Figure 16C:
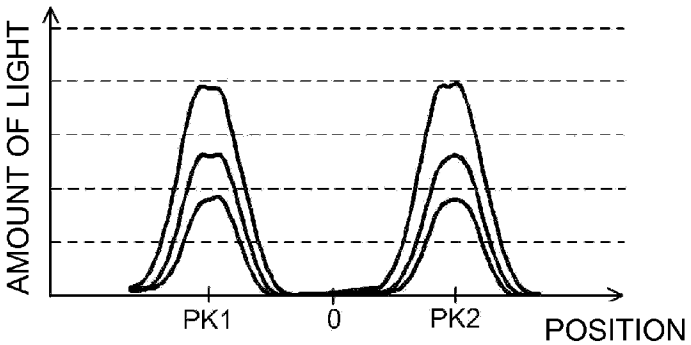

FIG. 16C is a graph for comparing the amounts of the reflected light Lr received by the light-receiving portion 94 when the holder 20 according to the first embodiment located at the positions "0", "+1", and "−1" with respect to the detection portion 90 is moved in the main scanning direction HD (Y-axis direction). As described above, when the holder 20 is at the position "+1" and at the position "−1", the distance to the detection portion 90 in the Z-axis direction is different from that when the holder 20 is at the position "0". Accordingly, there is a large difference in the amount of the received reflected light Lr.

FIG. 16D is a graph for comparing the amounts of the reflected light Lr received by the light-receiving portion 94 when the holder 50 according to the second embodiment located at the positions "0", "+1", and "−1" with respect to the detection portion 90 is moved in the main scanning direction HD (Y-axis direction). As described above, with the holder 50 according to the second embodiment, the amount of the received light is generally smaller, and the difference among the amounts of the received light at the positions "0", "+1", and "−1" is smaller, as compared with the case of the holder 20 according to the first embodiment.

Here, if the amount of the received reflected light Lr from the bottom face 170*c* from the prism 170 increases, the reflected light Lr from the bottom face 170*c* becomes noise light in the ink near-end determination in some cases. For this reason, if the amount of the received reflected light Lr from the bottom face 170*c* becomes excessively large or significantly varies, there is a possibility that the accuracy of the ink near-end determination decreases. Accordingly, with the configuration of the holder 50 according to the second embodiment, a decrease in the accuracy of the ink near-end determination can be suppressed even when the relative position of the holder 50 with respect to the detection portion 90 is shifted in the sub-scanning direction VD (X-axis direction).

Third Embodiment

Figure 17A:
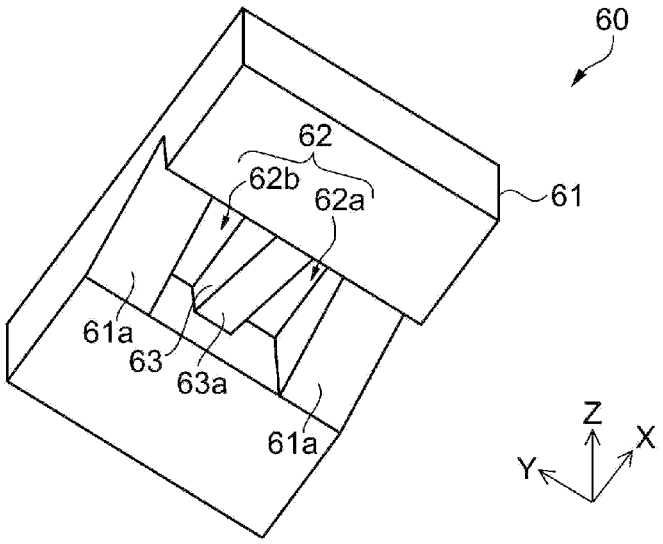
FIGS. 17A to 17C are diagrams illustrating inclined faces of a holder according to a third embodiment.
Figure 17B:
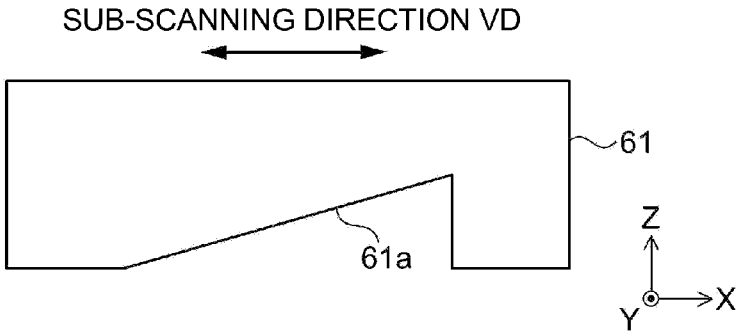
Figure 17C:
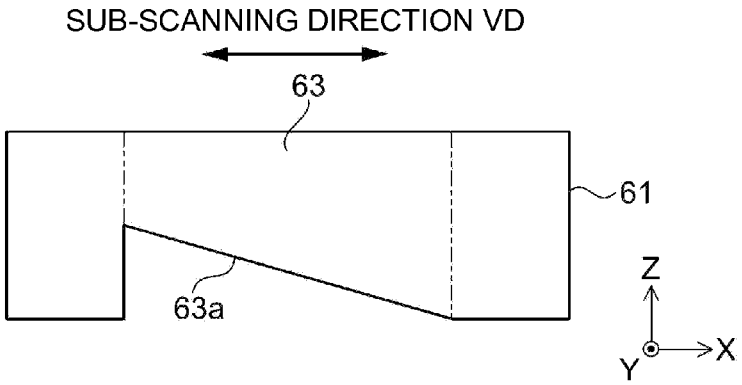

A printer according to a third embodiment has a configuration that is almost similar to that of the first embodiment, except that the holder has a different configuration. A difference from the holder 20 in the first embodiment will be described here. FIGS. 17A to 17C are diagrams illustrating inclined faces of the holder according to the third embodiment. FIG. 17A shows a holder 60 according to the third embodiment, and corresponds to an enlarged perspective view of the part D in FIG. 5A. FIG. 17B is a schematic view of an XZ cross-section of a bottom portion 61, and corresponds to a cross-sectional view taken along line B-B' in FIG. 5A. FIG. 17C is a schematic view of an XZ cross-section of a light-blocking portion 63, and corresponds to a cross-sectional view taken along line C-C' in FIG. 5A. The same constituent elements as those in the first embodiment will be given the same reference numerals, and descriptions thereof will be omitted.

Configuration and Effect of Holder

As shown in FIG. 17A, the holder 60 according to the third embodiment has, in the bottom portion 61, an inclined face 61*a* that inclines in the sub-scanning direction VD (X-axis direction). The holder 60 also has a light-blocking portion 63 that divides, in the sub-scanning direction VD (X-axis direction), an opening portion 62 into two parts, namely an opening portion 62*a* and an opening portion 62*b*, and the light-blocking portion 63 has an inclined face 63*a* that inclines in the sub-scanning direction VD (X-axis direction). As shown in FIGS. 17B and 17C, inclination orientations of the inclined face 61*a* and the inclined face 63*a* are opposite to each other. Accordingly, in the holder 60, the inclined face 61*a* and the inclined face 63*a* facing in opposite orientations are alternately arranged in the main scanning direction HD (Y-axis direction).

Figure 18A:
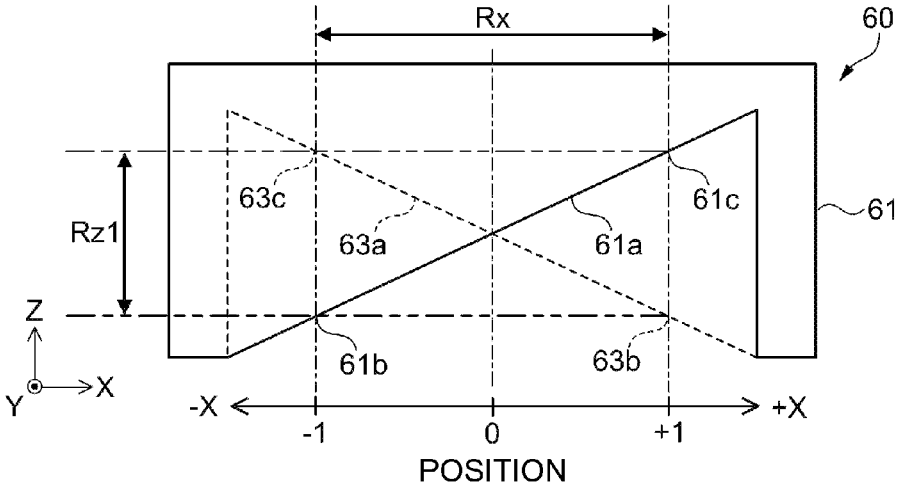
FIGS. 18A to 18C are diagrams illustrating an effect of the holder according to the third embodiment.
Figure 18B:
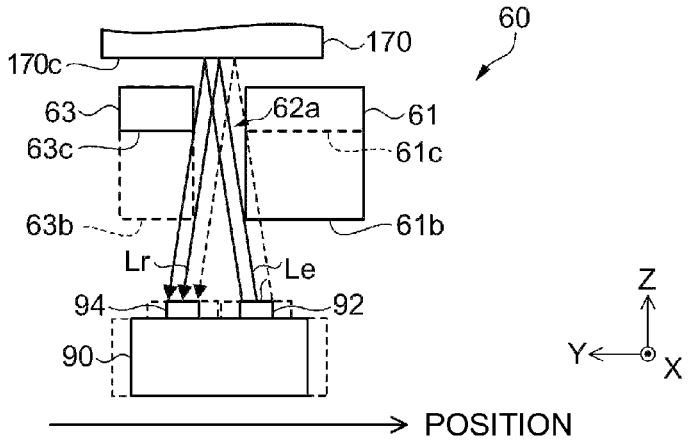
Figure 18C:
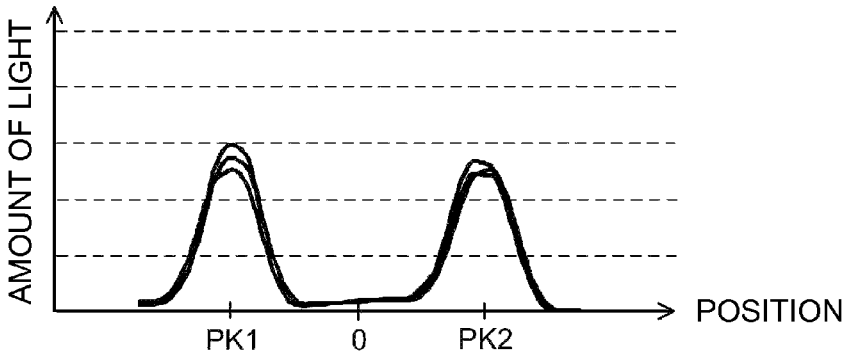

FIGS. 18A to 18C are diagrams illustrating an effect of the holder 60 according to the third embodiment. In FIG. 18A, an XZ cross-section of the bottom portion 61 of the holder 60 is indicated by solid lines as in FIG. 17B, and an XZ cross-section of the light-blocking portion 63 is indicated by broken lines in an overlaying manner as in FIG. 17C. It is assumed that the uppermost point of the inclined face 61*a* of the bottom portion 61 at the position "+1" is 61*c*, and the lowermost point thereof at the position "−1" is 61*b*. It is also assumed that the lowermost point of the inclined face 63*a* of the light-blocking portion 63 at the position "+1" is 63*b*, and the uppermost point thereof at the position "−1" is 63*c*.

In FIG. 18B, a YZ cross-section of the holder 60 (bottom portion 61) and the light-blocking portion 63 according to the third embodiment at the position "+1" is indicated by solid lines, and a YZ cross-section thereof at the position "−1" is indicated by broken lines. In the holder 60, the position "+1" indicated by solid lines corresponds to the lowermost point 61*b* of the bottom portion 61 and the uppermost point 63*c* of the light-blocking portion 63. Meanwhile, the position "−1" corresponds to the uppermost point 61*c* of the bottom portion 61 and the lowermost point 63*b* of the light-blocking portion 63. Accordingly, in a case where the holder 60 is shifted to the position "+1" in the +X direction and in a case where the holder 60 is shifted to the position "−1" in the −X direction, the amount of the radiated light Le entering the bottom face 170*c* of the prism 170 and the amount of the reflected light Lr received by the light-receiving portion 94 are almost the same.

FIG. 18C is a graph for comparing the amounts of the reflected light Lr received by the light-receiving portion 94 when the holder 60 according to the third embodiment located at the positions "0", "+1", and "−1" with respect to the detection portion 90 is moved in the main scanning direction HD (Y-axis direction). As described above, with the holder 60 according to the third embodiment, the amount of the received light does not excessively increase, and the difference among the amounts of the received light at the positions "0", "+1", and "−1" is smaller, as compared with the case of the holder 20 according to the first embodiment.

Accordingly, with the configuration of the holder 60 according to the third embodiment, a decrease in the accuracy of the ink near-end determination can be suppressed even when the relative position of the holder 60 with respect to the detection portion 90 is shifted in the sub-scanning direction VD (X-axis direction), as in the second embodiment.

Each of the above embodiments is only a mode of the invention, and can be arbitrarily modified and applied within the scope of the invention. For example, the following modifications are conceivable.

Modification 1

The holder 50 according to the second embodiment has a configuration in which a plurality of inclined faces 51*a* and inclined faces 53*a* that incline in the same orientation in the sub-scanning direction VD (X-axis direction) are provided respectively in the bottom portion 51 and the light-blocking portion 53. However, the invention is not limited to this mode. For example, a configuration may be employed in which the inclined faces of the bottom portion and the inclined faces in the light-blocking portion incline in opposite orientations.

Figure 19A:
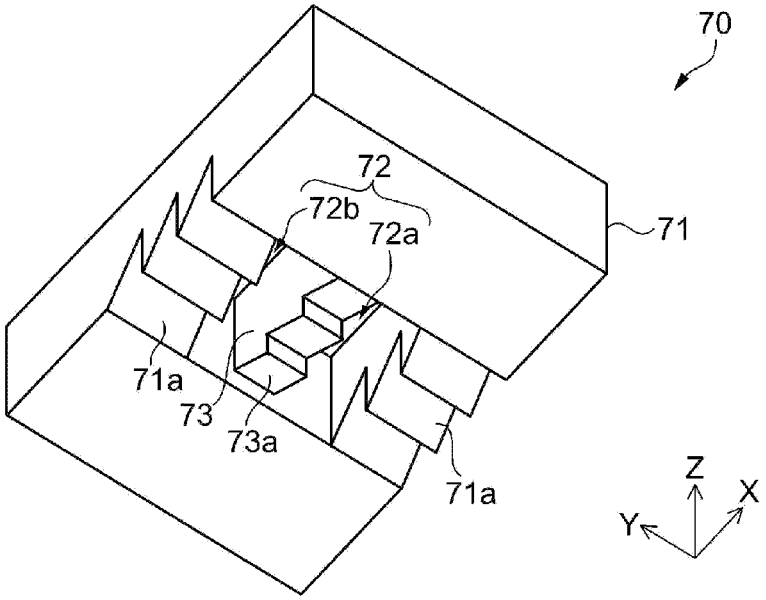
FIGS. 19A to 19C are diagrams illustrating inclined faces of a holder according to Modification 1.
Figure 19B:
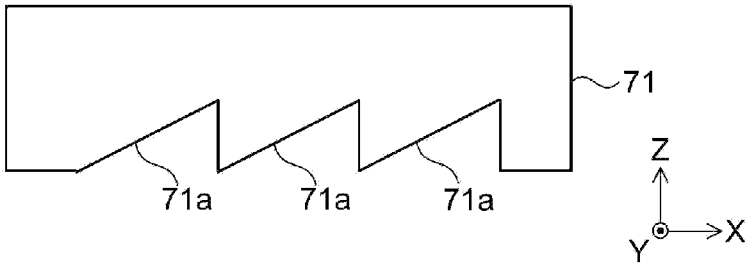
Figure 19C:
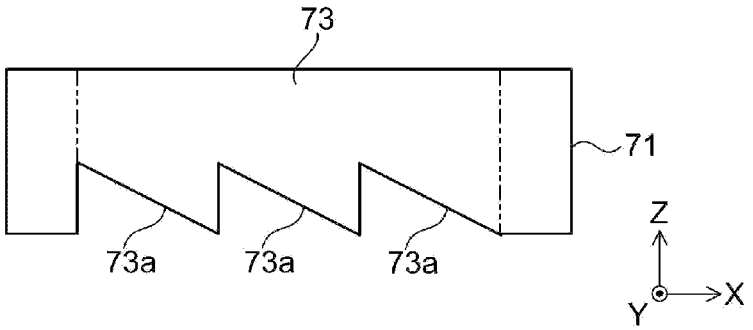

FIG. 19 is a diagram illustrating inclined faces of a holder according to Modification 1. FIG. 19A shows a holder 70 according to Modification 1, and corresponds to an enlarged perspective view of the part D in FIG. 5A. FIG. 19B is a schematic view of an XZ cross-section of a bottom portion 71, and corresponds to a cross-sectional view taken along line B-B' in FIG. 5A. FIG. 19C is a schematic view of an XZ cross-section of a light-blocking portion 73, and corresponds to a cross-sectional view taken along line C-C' in FIG. 5A. As shown in FIGS. 19A to 19C, the holder 70 according to Modification 1 has a plurality of inclined faces 71*a* in the bottom portion 71, and the light-blocking portion 73 has a plurality of inclined faces 73*a*, similarly to the holder 50 according to the second embodiment. However, the inclined faces 71*a* and the inclined faces 73*a* incline in opposite orientations. With this configuration, both the effect in the second embodiment and the effect in the third embodiment can be achieved. Note that a configuration may be employed in which one of the bottom portion 71 and the light-blocking portion 73 has a single inclined face, in place of the plurality of inclined faces.

Modification 2

Figure 20A:
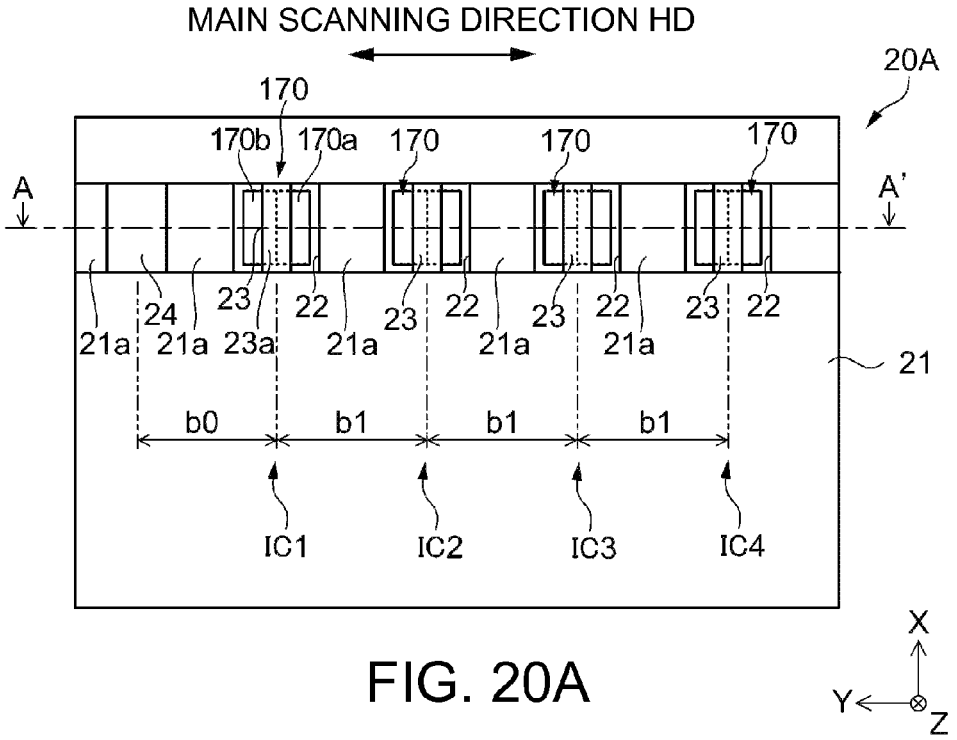
FIGS. 20A and 20B are diagrams illustrating a configuration of a holder according to Modification 2.
Figure 20B:
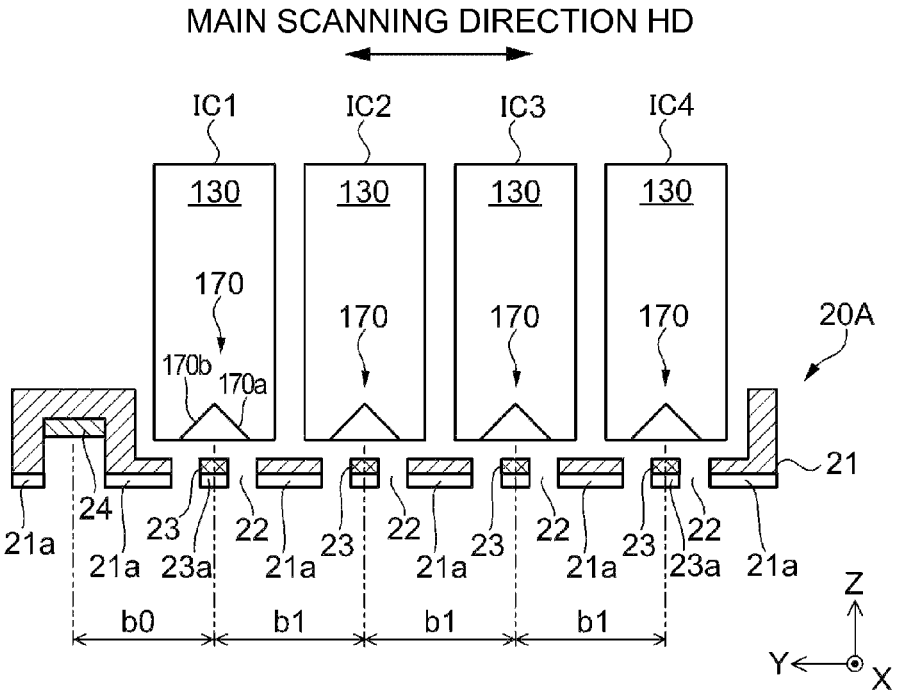

For example, the holder 20 according to the first embodiment may have a configuration in which a reflection portion is provided at a position separate from an opening portion 22 by a predetermined distance in the main scanning direction HD. FIGS. 20A and 20B are diagrams illustrating a configuration of a holder according to Modification 2. FIG. 20A is a schematic view of the bottom portion 21 of a holder 20A as seen from the side of the detection portion 90. FIG. 20B is a schematic view of a YZ cross-section of the holder 20A in which the ink cartridges IC are installed.

As shown in FIGS. 20A and 20B, the holder 20A according to Modification 2 has a reflection portion 24 at a position separate from one of the opening portions 22 by a predetermined distance b0 in the main scanning direction HD. The reflection portion 24 is provided at a place facing the light-emitting portion 92 and the light-receiving portion 94 when the reflection portion 24 is located immediately above the detection portion 90 as a result of the holder 20A moving back and forth. The reflection portion 24 is formed by a mirror capable of totally reflecting incident light, for example. The reflection portion 24 may be formed by coating the bottom portion 21 of the holder 20A with a reflector.

When the reflection portion 24 is located immediately above the detection portion 90 and the radiated light from the light-emitting portion 92 enters the reflection portion 24, the reflected light that is totally reflected at the reflection portion 24 enters the light-receiving portion 94. The position of the reflection portion 24 corresponds to a predetermined count value of the rotary encoder, and a count value based on a design value of the carriage CR is stored in the ROM in the control unit 40. During the position correction processing, a peak caused due to the reflected light that is totally reflected at the reflection portion 24 is detected from the detection voltage that is output from the detection portion 90, and primary correction processing is performed for correcting the center position of each prism 170, using the detected peak position (center position of the reflection portion 24) as a reference. Then, the peak detection in the above embodiments is also performed on the detection voltage of each ink cartridge IC at the position after the primary correction, and secondary correction processing is performed for correcting the center position of each prism 170, based on the detected peak position. Thus, the accuracy of the position correction processing can be further improved.

Also, light adjustment is performed by performing PWM control on the light-emitting portion 92, based on the detection voltage generated due to the reflected light that is totally reflected at the reflection portion 24. Thus, the amount of emitted light from the light-emitting portion 92 in the ink near-end determination processing and the position correction processing can be adjusted. Furthermore, a failure in the detection portion 90 can be detected. For example, if the reflected light from the reflection portion 24 is not detected, it is determined that the detection portion 90 has failed. In the configuration in which the reflection portion 24 is provided in the holder 20A as in Modification 2 as well, it is possible to suppress influence of light reflected at a portion other than the reflection portion 24 that may possibly hinder the aforementioned effect achieved by the reflection portion 24, as a result of the bottom portion 21 having the inclined face 21*a*. Accordingly, the accuracy of the ink near-end determination processing and the position correction processing can be further improved. Note that the configuration in Modification 2 can also be applied to the holders 50, 60, and 70 in the above embodiments and Modification 1.

Modification 3

Although the holders 20, 20A, 50, 60, and 70 according to the above embodiments and modifications have a configuration in which the light-blocking portions 23, 53, 63, and 73 are provided respectively in the opening portions 22, 52, 62, and 72, the invention is not limited to this mode. A configuration may be employed in which the light-blocking portions 23, 53, 63, and 73 are not provided. For example, with a configuration in which the reflection portion 24 is provided as in Modification 2, the center position of each prism 170 can be corrected based on the peak position detected using the reflected light from the reflection portion 24, without detecting the peaks Spk1 and Spk2 in the reflected light from the bottom face 170*c* of the prism 170.

Modification 4

The holders 20, 20A, 50, 60, and 70 according to the above embodiments and modifications have a configuration in which the inclined faces 21*a*, 51*a*, 61*a*, and 71*a* of the bottom portions 21, 51, 61, and 71 and the inclined faces 23*a*, 53*a*, 63*a*, and 73*a* of the light-blocking portions 23, 53, 63, and 73 incline in the X-axis direction. However, the invention is not limited to this mode. The second direction in which the inclined faces 21*a*, 51*a*, 61*a*, and 71*a* incline and the third direction in which the inclined faces 23*a*, 53*a*, 63*a*, and 73*a* incline may be any directions other than the direction (Y-axis direction) in which the light-emitting portion 92 and the light-receiving portion 94 are arranged. Furthermore, the second direction and the third direction may be different from each other.

Modification 5

Although the holders 20, 20A, 50, 60, and 70 according to the above embodiments and modifications have a configuration in which the opening portions 22, 52, 62, and 72 are provided respectively in the bottom portions 21, 51, 61, and 71, the invention is not limited to this mode. The opening portions 22, 52, 62, and 72 need only be provided at positions at which the corresponding prisms 170 and the detection portion 90 face each other. For example, the opening portions 22, 52, 62, and 72 may be provided on a side portion of the holders 20, 20A, 50, 60, and 70.

Modification 6

The holders 20, 20A, 50, 60, and 70 according to the above embodiments and modifications have a configuration in which four ink cartridges IC are installed, and the number of opening portions 22, 52, 62, and 72 corresponds to the number of the prisms 170 in the ink cartridges IC. However, the invention is not limited thereto. The number of installed ink cartridges IC and the number of corresponding opening portions 22, 52, 62, and 72 may be other than four.

Modification 7

The above embodiments and modifications have a configuration in which the light-emitting portion 92 and the light-receiving portion 94 provided in the detection portion 90 are arranged so as to be aligned with the main scanning direction HD (Y-axis direction) in which the carriage CR moves. However, the invention is not limited to this mode. For example, a configuration may be employed in which the light-emitting portion 92 and the light-receiving portion 94 are arranged so as to be aligned with the direction (X-axis direction) perpendicular to the main scanning direction HD.

Modification 8

The above embodiments and modifications have been described, taking, as an example, a case where the carriage CR moves in which the holders 20, 20A, 50, 60, and 70 are carried, the ink cartridges IC1 to IC4 being able to be attached to and detached from these holders, and the detection portion 90 is fixed to the printer body. However, the invention is not limited to this mode. For example, the carriage CR in which the detection portion 90 is carried may move, and the holders 20, 20A, 50, 60, and 70, to and from which the ink cartridges IC1 to IC4 can be attached and detached, may be fixed to the printer body. Any configuration may be employed in which the ink cartridges IC1 to IC4 and the detection portion 90 relatively move with respect to each other. Furthermore, a configuration may also be employed in which the holders 20, 20A, 50, 60, and 70 are fixed, and the detection portion 90 is arranged in the carriage CR including the print head 35.

Modification 9

The above embodiments and modifications have been described, using an example in which the invention is applied to a printer and ink cartridges. However, the invention is not limited to this mode. For example, the invention may also be used in a liquid consuming apparatus that ejects and discharges liquid other than ink, and can also be applied to a liquid vessel that contains such liquid. The liquid vessel of the invention can be used in various kinds of liquid consuming apparatus including a liquid ejection head that ejects miniscule droplets, and the like. "Droplets" refers to the state of the liquid discharged from the liquid consuming apparatus, and includes droplets having a granular shape, a tear-drop shape, and a shape having a thread-like trailing end. Furthermore, "liquid" mentioned here may be any kind of material that can be ejected by the liquid consuming apparatus. For example, the liquid need only be a material whose substance is in the liquid phase, and encompasses high or low viscosity liquid materials, as well as liquid materials such as sols, gel water, other inorganic solvents, organic solvents, solutions, liquid resins, and liquid metals (metal melts). Furthermore, the liquid is not limited to being a one-state substance, and also encompasses a substance in which functional material particles made of a solid substance such as pigment or metal particles are dissolved, dispersed, or mixed in a solvent. Representative examples of the liquid include ink such as that described in the above embodiment, and liquid crystal. Here, "ink" encompasses general water-based ink and oil-based ink, as well as various types of liquid compositions such as gel ink and hot melt-ink. Specific examples of the liquid consuming apparatus may include, for example, a liquid consuming apparatus that ejects liquid containing, in the form of dispersion or dissolution, a material such as an electrode material or a color material to be used in manufacturing or the like of a liquid crystal display, an EL (electro-luminescence) display, a surface-emitting display, or a color filter, a liquid consuming apparatus that ejects biological organic matter to be used in manufacturing of a biochip, and a liquid consuming apparatus that is used as a precision pipette and ejects liquid serving as a sample. Furthermore, it is also possible to employ a liquid consuming apparatus that ejects lubricating oil in a pinpoint manner to a precision machine such as a watch or a camera, a liquid consuming apparatus that ejects transparent resin liquid such as ultraviolet-cured resin onto a substrate, in order to form a micro-hemispherical lens (optical lens) or the like to be used in an optical communication device or the like, or a liquid consuming apparatus that ejects an etchant that is acid, alkaline, or the like, for etching a substrate or the like.

The entire disclosure of Japanese Patent Application No. 2013-247393, filed on Nov. 29, 2013, is expressly incorporated herein by reference.

What is claimed is:

1. A liquid consuming apparatus comprising:

a detection portion in which a light-emitting portion and a light-receiving portion are arranged in a first direction;

a holder on which a liquid containing portion having a prism, the prism having an edge line aligned with a direction intersecting the first direction and a face facing the detection portion, is detachably installed; and a moving portion that relatively moves the holder with respect to the detection portion in the first direction, wherein the holder has, in a portion thereof facing the detection portion, an opening portion at a position facing the face of the prism and the portion of the holder has, on a side facing the detection portion, a first inclined face inclining in a second direction that is other than the first direction.

2. The liquid consuming apparatus according to claim 1, wherein the holder holds a plurality of the liquid containing portions in an attachable and detachable manner, the opening portion is provided so as to correspond to the prism in each of the liquid containing portions, and the first inclined face is arranged between the opening portions that are adjacent to each other.

3. The liquid consuming apparatus according to claim 1, wherein the portion has a saw blade-like cross-sectional shape in which a plurality of the first inclined faces are arranged so as to be aligned with the second direction.

4. The liquid consuming apparatus according to claim 1, wherein the holder has a light-blocking portion provided so as to cover a part of the opening portion, and the light-blocking portion has, on a side facing the detection portion, a second inclined face inclining in a third direction that is other than the first direction.

5. The liquid consuming apparatus according to claim 4, wherein the second direction and the third direction are perpendicular to the first direction, and the first inclined face and the second inclined face incline in orientations opposite to each other.

* * * * *